United States Patent [19]

Dorer, Jr. et al.

[11] Patent Number: 4,623,684

[45] **Date of Patent: * Nov. 18, 1986**

[54] HYDROCARBYL SUBSTITUTED CARBOXYLIC ACYLATING AGENT DERIVATIVE CONTAINING COMBINATIONS, AND FUELS CONTAINING SAME

[75] Inventors: Casper J. Dorer, Jr., Lyndhurst; Katsumi Hayashi, Mentor, both of Ohio

[73] Assignee: The Lubrizol Corporation, Wickliffe, Ohio

[ * ] Notice: The portion of the term of this patent subsequent to Mar. 11, 2003 has been disclaimed.

[21] Appl. No.: 788,183

[22] Filed: Oct. 16, 1985

Related U.S. Application Data

[60] Continuation of Ser. No. 711,114, Mar. 12, 1985, Pat. No. 4,575,526, which is a division of Ser. No. 404,845, Aug. 9, 1982, Pat. No. 4,564,460.

[51] Int. Cl.[4] ..... C08K 5/35

[52] U.S. Cl. ..... 524/96; 525/186; 525/193; 525/222; 525/285; 528/341; 528/342

[58] Field of Search ..... 524/96; 525/186, 193, 525/222, 285; 528/341, 342

[56] References Cited

U.S. PATENT DOCUMENTS

| | | | |
|---|---|---|---|
| B 407, 812 | 3/19/76 | Price | 44/62 |
| 2,499,723 | 3/1971 | Coffman et al. | 252/56 |
| 2,588,412 | 3/1952 | Rocchini | 252/51.5 |
| 2,657,188 | 10/1953 | Denison et al. | 260/31.2 |
| 2,858,329 | 10/1958 | Brazten et al. | 260/48.5 |
| 2,892,786 | 6/1959 | Stewart et al. | 252/51.5 |
| 2,895,915 | 7/1959 | Hewett et al. | 252/59 |
| 3,024,195 | 3/1962 | Drummond et al. | 252/51.5 |
| 3,029,230 | 4/1962 | Strauss | 260/87.3 |
| 3,037,850 | 6/1962 | Wythe et al. | 44/62 |
| 3,048,479 | 8/1962 | Ilnyckyj et al. | 44/62 |
| 3,069,245 | 12/1962 | Wythe et al. | 44/62 |
| 3,087,894 | 4/1963 | McKegney et al. | 252/56 |
| 3,087,936 | 4/1963 | LeSuer | 260/326.3 |
| 3,093,623 | 6/1963 | Ilnyckyj | 260/87.3 |
| 3,100,695 | 8/1963 | Slysh et al. | 44/62 |
| 3,126,364 | 3/1964 | Ilnyckyj | 260/87.3 |
| 3,131,168 | 4/1964 | Ilnyckyj | 260/87.3 |
| 3,159,608 | 12/1964 | Ilnyckyj | 260/87.3 |
| 3,172,892 | 3/1965 | LeSuer et al. | 260/326.5 |
| 3,184,474 | 5/1965 | Catto et al. | 260/326.3 |
| 3,194,812 | 7/1965 | Norman et al. | 260/326.5 |
| 3,200,076 | 8/1965 | Anderson et al. | 252/51.5 |
| 3,202,678 | 8/1965 | Stuart et al. | 260/326.5 |
| 3,210,283 | 10/1965 | Stuart et al. | 252/51.5 |
| 3,214,460 | 10/1965 | McGee et al. | 260/482 |
| 3,216,936 | 11/1965 | LeSuer | 252/32.7 |
| 3,219,666 | 11/1965 | Norman et al. | 260/326.5 |
| 3,220,949 | 11/1965 | Bell et al. | 252/51.5 |
| 3,235,503 | 2/1966 | deVries | 252/51.5 |
| 3,236,612 | 2/1966 | Ilnyckyj | 44/62 |
| 3,250,599 | 5/1966 | Kirk et al. | 44/62 |
| 3,250,714 | 5/1966 | Ilnyckyj et al. | 252/56 |
| 3,252,908 | 5/1966 | Coleman | 252/31 |
| 3,255,108 | 6/1966 | Wiese | 252/32.7 |
| 3,269,946 | 8/1966 | Wiese | 252/32.5 |
| 3,272,746 | 9/1966 | LeSuer et al. | 252/47.5 |

(List continued on next page.)

*Primary Examiner*—Schofer Joseph L.
*Assistant Examiner*—N. Sarofim
*Attorney, Agent, or Firm*—D. A. Polyn; F. C. Collins; K. Bozicevic

[57] ABSTRACT

A composition comprising:

(A) a first component selected from the group consisting of:

(i) an oil-soluble ethylene backbone polymer having a number average molecular weight in the range of about 500 to about 50,000;

(ii) a hydrocarbyl-substituted phenol of the formula $$(R^*)_a—Ar—(OH)_b \qquad I$$

wherein $R^*$ is a hydrocarbyl group selected from the group consisting of hydrocarbyl groups of from about 8 to about 30 carbon atoms and polymers of at least 30 carbon atoms; Ar is an aromatic moiety having 0 to 4 optional substituents selected from the group consisting of lower alkyl, lower alkoxyl, nitro, halo or combinations of two or more of said optional substituents, and a and b are each independently an integer of 1 up to 5 times the number of aromatic nuclei present in Ar with the proviso the sum of a and b does not exceed the unsatisfied valences of Ar;

(iii) mixtures of (i) and (ii); and (B) as a second component, the reaction product of (B)(I) a hydrocarbyl-substituted carboxylic acylating agent with (B)(II) one or more amines, one or more alcohols, or a mixture of one or more amines and/or one or more alcohols, the hydrocarbyl substituent of said agent (B)(I) being selected from the group consisting of (i') one or more mono-olefins of from about 8 to about 30 carbon atoms;

(ii') mixtures of one or more mono-olefins of from about 8 to about 30 carbon atoms with one or more olefin polymers of at least 30 carbon atoms selected from the group consisting of polymers of mono-olefins of from 2 to 8 carbon atoms, or the chlorinated or brominated analogs of such polymers; and (iii') one or more olefin polymers of at least 30 carbon atoms selected from the group consisting of (a) polymers of mono-olefins of from about 8 to about 30 carbon atoms;

(b) interpolymers of mono-1-olefins of from 2 to 8 carbon atoms with mono-olefins of from about 8 to about 30 carbon atoms;

(c) one or more mixtures of homopolymers and/or interpolymers of mono-1-olefins of from 2 to 8 carbon atoms with homopolymers and/or interpolymers of mono-olefins of from about 8 to about 30 carbon atoms; and (d) chlorinated or brominated analogs of (a), (b), or (c).

3 Claims, No Drawings

U.S. PATENT DOCUMENTS

| | | | |
|---|---|---|---|
| 3,274,113 | 9/1966 | Reiland | 252/78 |
| 3,275,427 | 9/1966 | Brownawell et al. | 44/62 |
| 3,288,577 | 11/1966 | Patinkin et al. | 44/62 |
| 3,306,908 | 2/1967 | LeSuer | 260/326.3 |
| 3,309,181 | 3/1967 | Berkowitz et al. | 44/62 |
| 3,311,558 | 3/1967 | Pricer et al. | 252/47.5 |
| 3,311,561 | 3/1967 | Anderson et al. | 252/75 |
| 3,312,619 | 4/1967 | Vineyard | 252/47.5 |
| 3,324,033 | 6/1967 | Knapp | 252/51.5 |
| 3,324,034 | 6/1967 | Merz et al. | 252/56 |
| 3,325,460 | 6/1967 | Schellenberg et al. | 260/87.3 |
| 3,341,309 | 9/1967 | Ilnyckyj | 44/62 |
| 3,341,542 | 9/1967 | LeSuer et al. | 260/268 |
| 3,364,001 | 1/1968 | Drummond et al. | 44/71 |
| 3,367,943 | 2/1968 | Miller et al. | 260/326.3 |
| 3,379,515 | 4/1968 | Lindstrom et al. | 44/62 |
| 3,381,022 | 4/1968 | LeSuer | 260/404.8 |
| 3,382,092 | 5/1968 | Ilnyckyj et al. | 117/97 |
| 3,388,977 | 6/1968 | Burkard et al. | 44/62 |
| 3,389,087 | 12/1965 | Kresge et al. | 252/59 |
| 3,389,979 | 6/1968 | Brownawell et al. | 44/62 |
| 3,397,970 | 8/1968 | Strickland | 44/62 |
| 3,399,141 | 8/1968 | Clemens | 252/47.5 |
| 3,401,118 | 9/1968 | Benoit | 252/51.5 |
| 3,413,104 | 11/1968 | Mehmedbasich | 44/62 |
| 3,427,245 | 2/1969 | Hotten | 252/34.7 |
| 3,438,899 | 4/1969 | Benoit | 252/51.5 |
| 3,444,082 | 5/1969 | Kautsky | 252/51.5 |
| 3,448,049 | 6/1969 | Presiss et al. | 252/51.5 |
| 3,449,251 | 6/1969 | Amboy et al. | 252/52 |
| 3,450,715 | 6/1969 | Lindstrom et al | 260/326.3 |
| 3,451,933 | 6/1969 | Leister | 252/51.5 |
| 3,452,002 | 6/1969 | Brasch | 260/239.3 |
| 3,454,496 | 7/1969 | Schlobohm et al. | 252/32.7 |
| 3,455,827 | 7/1969 | Mehmedbasich et al. | 252/32.7 |
| 3,466,265 | 9/1969 | Alexander et al. | 260/78.5 |
| 3,471,273 | 10/1969 | Young et al. | 44/62 |
| 3,476,686 | 11/1969 | Verdot et al. | 252/51.5 |
| 3,502,677 | 3/1970 | LeSuer | 260/268 |
| 3,505,227 | 4/1970 | Lowe | 252/51.5 |
| 3,513,095 | 5/1970 | Love et al. | 252/51.5 |
| 3,522,179 | 7/1970 | LeSuer | 252/51.5 |
| 3,523,768 | 8/1970 | Mehmedbasich et al. | 44/62 |
| 3,525,693 | 8/1970 | Lyle et al. | 252/34 |
| 3,544,467 | 12/1970 | Kautsky | 252/51.5 |
| 3,551,336 | 12/1970 | Jacobsson et al. | 252/59 |
| 3,565,947 | 2/1971 | Ilnyckyj | 260/485 |
| 3,567,639 | 3/1971 | Aaron et al. | 252/56 |
| 3,573,205 | 3/1971 | Lowe et al. | 252/51.5 |
| 3,576,743 | 4/1971 | Widmer et al. | 252/51.5 |
| 3,585,194 | 6/1971 | Leister | 260/268 |
| 3,598,552 | 8/1971 | Cohen et al. | 44/62 |
| 3,620,696 | 11/1971 | Hollyday et al. | 44/62 |
| 3,627,838 | 12/1971 | Ilnyckyj | 260/87.3 |
| 3,629,119 | 12/1971 | Weaver | 252/77 |
| 3,630,904 | 12/1971 | Musser et al | 252/51.5 |
| 3,632,511 | 1/1972 | Lisa | 252/51.5 |
| 3,638,349 | 2/1972 | Wisotsky et al. | 44/62 |
| 3,642,459 | 2/1972 | Ilnyckyj | 44/62 |
| 3,645,704 | 2/1972 | Burkard et al. | 44/62 |
| 3,658,493 | 4/1972 | Hollyday | 44/62 |
| 3,658,707 | 4/1972 | Delafield et al. | 252/51.5 |
| 3,687,644 | 5/1972 | Delafield et al. | 44/56 |
| 3,764,536 | 10/1973 | Heilmuth et al. | 252/49.7 |
| 3,773,478 | 11/1973 | Feldman | 44/62 |
| 3,783,131 | 1/1974 | LeSuer | 252/34.7 |
| 3,790,359 | 2/1974 | Feldman | 44/62 |
| 3,795,495 | 3/1974 | Howland et al. | 44/58 |
| 3,832,150 | 8/1974 | Feldman | 44/62 |
| 3,833,624 | 9/1974 | Bork | 260/404.5 |
| 3,841,850 | 10/1974 | Aaron et al. | 44/62 |
| 3,846,093 | 11/1974 | Feldman | 44/62 |
| 3,847,561 | 11/1974 | Feldman | 44/62 |
| 3,850,587 | 11/1974 | Trout | 44/62 |
| 3,854,893 | 12/1974 | Rossi | 44/62 |
| 3,862,825 | 1/1975 | Sweeney | 44/62 |
| 3,883,318 | 5/1975 | Feldman et al. | 44/62 |
| 3,897,456 | 7/1975 | Brewster | 260/340.2 |
| 3,910,776 | 10/1975 | Feldman | 44/62 |
| 3,950,341 | 4/1976 | Okamoto et al. | 260/268 |
| 3,955,940 | 5/1976 | Hollyday | 44/62 |
| 3,961,915 | 6/1976 | Wisotsky | 44/62 |
| 3,961,916 | 6/1976 | Ilnyckyj et al. | 44/62 |
| 3,966,620 | 6/1976 | Bridger et al. | 252/33.4 |
| 3,981,850 | 9/1976 | Wisotsky et al. | 526/227 |
| 3,982,909 | 9/1976 | Hollyday | 44/66 |
| 4,014,662 | 3/1977 | Miller et al. | 44/62 |
| 4,019,878 | 4/1977 | Wisotsky | 44/62 |
| 4,048,080 | 9/1977 | Lee et al. | 252/51.54 |
| 4,058,371 | 11/1977 | Ilnyckyj | 44/62 |
| 4,087,255 | 5/1978 | Wisotsky et al. | 44/62 |
| 4,098,585 | 7/1978 | Vartanian et al. | 44/63 |
| 4,102,798 | 7/1978 | Ryer et al. | 252/51.5 |
| 4,113,639 | 9/1978 | Lonstrup et al. | 252/51.5 |
| 4,144,181 | 3/1979 | Elliott et al. | 252/33 |
| 4,147,520 | 4/1979 | Ilnyckyj | 44/62 |
| 4,148,605 | 4/1979 | Andress | 422/7 |
| 4,153,422 | 5/1979 | Wisotsky | 44/62 |
| 4,153,423 | 5/1979 | Wisotsky | 44/62 |
| 4,175,926 | 11/1979 | Wisotsky | 44/62 |
| 4,178,950 | 12/1979 | Sweeney | 137/13 |
| 4,178,951 | 12/1979 | Sweeney | 137/13 |
| 4,185,485 | 1/1980 | Schick et al. | 72/42 |
| 4,199,462 | 4/1980 | Soula et al. | 252/51.5 |
| 4,210,424 | 7/1980 | Feldman et al. | 44/62 |
| 4,211,534 | 7/1980 | Feldman | 44/62 |
| 4,234,435 | 11/1980 | Meinhardt et al. | 252/51.5 |
| 4,257,779 | 3/1981 | Sung et al. | 44/63 |
| 4,261,703 | 4/1981 | Tack et al. | 44/62 |
| 4,347,148 | 8/1982 | Davis | 252/51.5 |
| 4,367,074 | 1/1983 | Maldonado et al. | 44/62 |
| 4,375,973 | 3/1983 | Rossi et al. | 44/62 |
| 4,379,065 | 4/1983 | Lange | 252/51.5 |
| 4,386,939 | 6/1983 | Lange | 44/63 |

HYDROCARBYL SUBSTITUTED CARBOXYLIC ACYLATING AGENT DERIVATIVE CONTAINING COMBINATIONS, AND FUELS CONTAINING SAME

This is a continuation application of U.S. application Ser. No. 711,114, filed Mar. 12, 1985, now U.S. Pat. No. 4,575,526, which in turn was a divisional application of U.S. application Ser. No. 404,845, filed Aug. 9, 1982, now U.S. Pat. No. 4,564,460. The disclosures of said earlier applications are incorporated herein by reference in their entirety.

FIELD OF THE INVENTION

This invention relates to aditive combinations for improving the cold flow characteristics of hyrocarbon fuel compositions. More specifically, this invention relates to additive combinations for depressing the pour point of such fuel compositions and for dispersing or suspending wax crystals that form when such fuel compositions are cooled.

BACKGROUND OF THE INVENTION

The pour point of an oil is defined as the lowest temperature at which the oil will pour or flow when chilled without disturbance under specified conditions. The problems associated with pour point ordinarily have to do with the storage and use of heavy oils such as lubricating oils, but the recent increased use of distillate fuel oils have revealed similar problems even with these lighter, more fluid materials. Pour point problems arise through the formation of solid or semi-solid waxy particles in an oil composition. In the storage of furnace oils or diesel oils during the winter months, for example, temperatures may decrease to a point as low as −15° F. to −25° F. The decreased temperatures often cause crystallization and solidication of wax in the distillate fuel oil. Distribution of heating oils by pumping or siphoning is rendered difficult or impossible when temperatures are around or below the pour point of the oil. Furthermore, at such temperature, the flow of the oil through the filters cannot be maintained, and the result is a failure of the equipment to operate.

This difficulty has been remedied in some instances by using lighter fractions as fuel oils, i.e., by lowering the maximum distillation temperature at which a distillate fraction is cooled. It has also been suggested that the distillate fuel oils be dewaxed such as by urea dewaxing. Separately or in combination, these remedies are, however, economically prohibitive. That is, readjustment of end points causes the loss of valuable blending material for distillate fuel stocks and dewaxing operations are expensive.

Another approach to the problem has involved a search for a pour point depressant which will decrease the pour point of the distillate fuel oil. Unfortunately, pour point depressants which are normally effective in lubricating oils and other heavy oils are generally ineffective in distillate fuel oil. Such pour point depressants are also, in many instances, ineffective in dispersing or suspending wax crystals that form in the fuel oil, and often migrate along with other additives to the bottom of the storage vessel with the wax crystals. This latter problem is particularly true of copolymers of ethylene vinyl acetate under various circumstances.

Ethylene containing copolymer additives for use as pour point depressants for fuel oils are described in U.S. Pat. Nos. 3,037,850; 3,048,479; 3,069,245; 3,093,623; 3,126,364; 3,131,168; 3,159,608; 3,254,063; 3,309,181; 3,341,309; 3,388,977; 3,449,251; 3,565,947; and 3,627,838.

Additive combinations that include ethylene copolymers that are useful as pour point depressant and/or wax suspension or dispersion agents in fuel oils are described in U.S. Pat. Nos. 3,642,459; 3,638,349; 3,658,493; 3,660,058; 3,790,359; 3,955,940; 3,961,916; 3,981,850; 4,087,255; 4,147,520; 4,175,926; 4,211,534; 4,230,811; and 4,261,703.

Hydrocarbyl-substituted carboxylic acylating agents having at least 30 aliphatic carbon atoms in the substituent are known. The use of such carboxylic acylating agents as additives in normally liquid fuels and lubricants is discussed in U.S. Pat. Nos. 3,288,714 and 3,346,354. These acylating agents are also useful as intermediates for preparing additives for use in normally liquid fuels and lubricants as described in U.S. Pat. Nos. 2,892,786; 3,087,936; 3,163,603; 3,172,892; 3,189,544; 3,215,707; 3,219,666; 3,231,587; 3,235,503; 3,272,746; 3,306,907; 3,306,908; 3,331,776; 3,341,542; 3,346,354; 3,374,174; 3,379,515; 3,381,022; 3,413,104; 3,450,715; 3,454,607; 3,455,728; 3,476,686; 3,513,095; 3,523,768; 3,630,904; 3,632,511; 3,697,428; 3,755,169; 3,804,763; 3,836,470; 3,862,981; 3,936,480; 3,948,909; 3,950,341 and French Pat. No. 2,223,415. The preparation of such substituted carboxylic acid acylating agents is known. Typically, such acylating agents are prepared by reacting one or more olefin polymers which contain an average of, for example, from about 30 to about 300 aliphatic carbon atoms, with one or more unsaturated carboxylic acid acylating agents. The use of chlorine in the preparation of such acylating agents has been suggested as a means for improving the conversion of the reaction of olefin polymers and unsaturated carboxylic acid acylating agents. Methods for preparing substituted carboxylic acid acylating agents by this method are disclosed in U.S. Pat. Nos. 3,215,707; 3,219,666; 3,231,587; 3,787,374 and 3,912,764.

Reactions of such substituted carboxylic acylating agents with amines and/or alcohols to form additives for use in fuels and/or lubricants are described in U.S. Pat. Nos. 3,219,666; 3,252,908; 3,255,108; 3,269,946; 3,311,561; 3,364,001; 3,378,494; 3,502,677; 3,658,707; 3,687,644; 3,708,522; 4,097,389; 4,225,447; 4,230,588; and No. Re. 27,582.

Although many pour point depressant/wax suspension additive systems have been suggested, concerted efforts are constantly being made to find new additives or additive systems which are more economical and more effective than the additives and additive systems known in the art.

SUMMARY OF THE INVENTION

Additive combinations are provided in accordance with the present invention which when added to fuel oil compositions enhance the cold flow characteristics of such compositions by decreasing the pour point of such compositions and suspending and/or dispersing wax crystals that form when such fuel oil compositions are cooled. The dispersion of the pour point depressant component of such combinations as well as other additives in the fuel oil is also enhanced, i.e., the tendency of such depressant and other additives to migrate to the bottom of the storage vessel is greatly reduced.

Broadly stated, the present invention contemplates the provision of a composition comprising (A) a first component selected from the group consisting of:

(i) an oil-soluble ethylene backbone polymer having a number average molecular weight in the range of about 500 to about 50,000;

(ii) a hydrocarbyl-substituted phenol of the formula $$(R^*)_a—Ar—(OH)_b \quad I$$

wherein R* is a hydrocarbyl group selected from the group consisting of hydrocarbyl groups of from about 8 to about 30 carbon atoms and polymers of at least 30 carbon atoms, Ar is an aromatic moiety having 0 to 4 optional substituents selected from the group consisting of lower alkyl, lower alkoxyl, nitro, halo or combinations of two or more of said optional substituents, and a and b are each independently an integer of 1 up to 5 times the number of aromatic nuclei present in Ar with the proviso that the sum of a and b does not exceed the unsatisfied valences of Ar;

(iii) mixtures of (i) and (ii); and (B) as a second component, the reaction product of (B)(I) a hydrocarbyl-substituted carboxylic acylating agent with (B)(II) one or more amines, one or more alcohols, or a mixture of one or more amines and/or one or more alcohols, the hydrocarbyl substituent of (B)(I) being selected from the group consisting of (i') one or more mono-olefins of from about 8 to about 30 carbon atoms;

(ii') mixtures of one or more mono-olefins of from about 8 to about 30 carbon atoms with one or more olefin polymers of at least 30 carbon atoms selected from the group consisting of polymers of mono-1-olefins of from 2 to 8 carbon atoms, or the chlorinated or brominated analogs of such polymers; and (iii') one or more olefin polymers of at least 30 carbon atoms selected from the group consisting of (a) polymers of mono-olefins of from about 8 to about 30 carbon atoms;

(b) interpolymers of mono-1-olefins of from 2 to 8 carbon atoms with mono-olefins of from about 8 to about 30 carbon atoms;

(c) one or more mixtures of homopolymers and/or interpolymers of mono-1-olefins of from 2 to 8 carbon atoms with homopolymers and/or interpolymers of mono-olefins of from about 8 to about 30 carbon atoms; and (d) chlorinated or brominated analogs of (a), (b) or (c).

Fuel oil compositions and additive concentrates comprising the foregoing additive combinations are also provided in accordance with the present invention.

DESCRIPTION OF THE PREFERRED EMBODIMENTS

The term "hydrocarbyl" (and cognate terms such as hydrocarbyloxy, hydrocarbylmercapto, etc.) is used herein to include substantially hydrocarbyl groups (for example, substantially hydrocarbyloxy, substantially hydrocarbylmercapto, etc.), as well as purely hydrocarbyl groups. The description of these groups as being substantially hydrocarbyl means that they contain no non-hydrocarbyl substituents or non-carbon atoms which significantly affect the hydrocarbyl characteristics or properties of such groups relevant to their uses as described herein. For example, in the context of this invention, a purely hydrocarbyl $C_{40}$ alkyl group and a $C_{40}$ alkyl group substituted with a methoxy substituent are substantially similar in their properties with regard to their use in this invention and would be hydrocarbyl.

Non-limiting examples of substituents which do not significantly alter the hydrocarbyl characteristics or properties of the general nature of the hydrocarbyl groups of this invention are the following:

Ether groups (especially hydrocarbyloxy such as phenoxy, benzyloxy, methoxy, n-butoxy, etc., and particularly alkoxy groups of up to ten carbon atoms)

Oxo groups (e.g., —O— linkages in the main carbon chain

Nitro groups

Thioether groups (especially $C_{1-10}$ alkyl thioether)

Thia groups (e.g., —S— linkages in the main carbon chain)

Carbohydrocarbyloxy groups (e.g., $$-\overset{O}{\overset{\|}{C}}-O-\text{hydrocarbyl})$$

Sulfonyl groups (e.g., $$-\overset{O}{\underset{O}{\overset{\|}{\underset{\|}{S}}}}-\text{hydrocarbyl})$$

Sulfinyl groups (e.g., $$-\overset{O}{\overset{\|}{S}}-\text{hydrocarbyl})$$

This list is intended to be merely illustrative and not exhaustive, and the omission of a certain class of substituent is not meant to require its exclusion. In general, if such substituents are present, there will not be more than two for each ten carbon atoms in the substantially hydrocarbyl group and preferably not more than one for each ten carbon atoms since this number of substituents usually will not substantially affect the hydrocarbyl characteristics and properties of the group. Nevertheless, the hydrocarbyl groups usually will be free from non-hydrocarbon groups due to economic considerations; that is, they will be purely hydrocarbyl groups consisting of only carbon and hydrogen atoms.

The term "lower" as used in the present specification and claims, when used in conjunction with terms such as alkyl, alkenyl, alkoxy, and the like, is intended to describe such radicals which contain a total of up to seven carbon atoms.

The Component (A)(i):

Component (A)(i) are homopolymers or interpolymers of one or more ethylenically unsaturated monomers and have a number average molecular weight in the range of about 500 to 50,000, preferably about 500 to about 10,000, and more preferably about 1,000 to 6,000. In a particularly advantageous embodiment the number average molecular weight is in the range of about 1,500 to 3,000, preferably 2,000 to 2,500.

The unsaturated monomers include unsaturated mono- and diesters of the general formula:

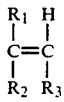

wherein $R_1$ is hydrogen or $C_1$ to $C_6$ hydrocarbyl, preferably alkyl such as methyl; $R_2$ is a —$OOCR_4$ or —$COOR_4$ group wherein $R_4$ is hydrogen or a $C_1$ to $C_{30}$, preferably a $C_1$ to $C_{16}$, and more preferably $C_1$ to $C_4$, straight or branched chain alkyl group; and $R_3$ is hydrogen or —$COOR_4$. The monomer, when $R_1$ and $R_3$ are hydrogen and $R_2$ is —$OOCR_4$ includes vinyl alcohol esters of $C_2$ to $C_{17}$ monocarboxylic acids, preferably $C_2$ to $C_5$ monocarboxylic acids. Examples of such esters include vinyl acetate, vinyl isobutyrate, vinyl laurate, vinyl myristate, vinyl palmitate, etc. When $R_2$ is —$COOR_4$, such esters include methyl acrylate, methyl methacrylate, lauryl acrylate, palmityl alcohol ester of alpha-methyl-acrylic acid, $C_{13}$ Oxo alcohol esters of methacrylic acid, behenyl acrylate, behenyl methacrylate, tricosenyl acrylate, etc. Examples of monomers where $R_1$ is hydrogen and $R_2$ and $R_3$ are —$COOR_4$ groups, include mono and di-esters of unsaturated dicarboxylic acids such as mono $C_{13}$ Oxo fumarate, di-$C_{13}$ Oxo fumarate, di-isopropyl maleate; di-lauryl fumarate; ethyl methyl fumarate; dieicosyl fumarate, laurylhexyl fumarate, didocosyl fumarate, dieicosyl maleate, didocosyl citraconate, monodocosyl maleate, dieicosyl citrfaconate, di(tricosyl) fumarate, dipentacosyl citraconate, etc.

In a preferred embodiment one or more of the foregoing mono- or diesters are copylymerized with ethylene. These copolymers generally have about 3 to 40, preferably 3 to 20, moles of ethylene per mole of such ester(s). In a particularly advantageous embodiment the oil soluble copolymers of ethylene and vinyl acetate with number average molecular weights in the range of about 1,000 to 6,000, preferably 1,500 to 3,000, and more preferably about 2,000 to 2,500. These ethylene/vinyl acetate copolymers have vinyl acetate contents of about 20 to about 50 percent by weight, preferably about 30 to about 40 weight percent. These copolymers also have about 2 to 10, preferably 3 to 6, and more preferably about 5 methyl terminating side branches per 100 methylene groups.

In another preferred embodiment, copolymers of vinyl acetate and dialkyl fumarate in about equal molar proportions, and polymers and copolymers of acrylic esters or methacrylic esterss are provided. The alcohols used to prepare the fumarate and the acrylic and methacrylic ester are usually monohydric saturated straight chain primary aliphatic alcohols of about 4 to about 30 carbon atoms.

In general, the polymerizations involving ethylene can be carried out as follows: Solvent and a portion of the unsaturated ester, e.g., 0–50, preferably 10 to 30 wt. %, of the total amount of unsaturated ester used in the batch, are charged to a stainless pressure vessel which is equipped with a stirrer. The temperature of the pressure vessel is then brought to the desired reaction temperature and pressured to the desired pressure with ethylene. Then catalyst, preferably dissolved in solvent so that it can be pumped, and additional amounts of unsaturated ester are added to the vessel continuously, or at least periodically, during the reaction time, which continuous addition gives a more homogeneous copolymer product as compared to adding all the unsaturated ester at the beginning of the reaction. Also during this reaction time, as ethylene is consumed in the polymerization reaction, additional ethylene is supplied through a pressure controlling regulator so as to maintain the desired reaction pressure fairly constant at all times. Following the completion of the reaction, the liquid phase of the pressure vessel is distilled to remove the solvent and other volatile constituents of the reacted mixture, leaving the polymer as residue.

Usually based upon 100 parts by weight of copolymer to be produced, then about 100 to 600 parts by weight of solvent, and about 1 to 20 parts by weight of catalyst, will be used.

The solvent can be any substantially non-reactive organic solvent for furnishing a liquid phase reaction which will not poison the catalyst or otherwise interfere with the reaction. Examples of solvents which may be used include $C_5$ to $C_{10}$ hydrocarbons, which can be aromatic such as benzene, toluene, etc.; aliphatic such as n-heptane, n-hexane, n-octane, isoctane, etc.; cycloaliphatic such as cyclohexane, cyclopentane, etc. Various polar solvents may also be used such as hydrocarbyl esters, ethers and ketones of 4 to 10 carbon atoms such as ethyl acetate, methyl butyrate, acetone, dioxane, etc. may also be used. While any of the preceding solvents, or mixtures thereof may be used, the aromatic solvents are, generally speaking, less preferred since they tend to give lower yields of polymer per amount of catalyst than other solvents. A particularly preferred solvent is cyclohexane.

The temperature used during the reaction will be in the range of 70° to 130° C., preferably 80° to 125° C.

Preferred free radical catalysts are those which decompose rather rapidly at the prior noted reaction temperatures, for example those that have a half life of about an hour or less at 130° C. preferably. In general this will include the acyl peroxides of $C_2$ to $C_{18}$, branched or unbranched, carboxylic acids such as diacetyl peroxide (half life of 1.1 hours at 85° C.); dipropionyl peroxide (half life of 0.7 hours at 85° C.); dipelargonyl peroxide (half life of 0.25 hour at 80° C.); dilauroyl peroxide (half life of 0.1 hour at 100° C.), etc. The lower peroxides such as di-acetyl and di-propionyl peroxide are less preferred because they are shock sensitive, and as a result the higher peroxides such as dilauroyl peroxide are especially preferred. The short half life catalysts of the invention also include various azo free radical initiators such as azodiisobutyronitrile (half life, 0.12 hour at 100° C.); azobis-2-methylheptonitrile and azobis-2-methyl-valeronitrile.

The pressures employed can range between 500 to 30,000 psig. However, relatively moderate pressures of 700 to about 3000 psig will generally suffice with vinyl esters such as vinyl acetate. In the case of esters having a lower relative reactivity to ethylene, such as methyl methacrylate, then somewhat higher pressures, such as 3,000 to 10,000 psi have been found to give more optimum results than lower pressures. In general, the pressure should be at least sufficient to maintain a liquid phase medium under the reaction conditions, and to maintain the desired concentration of ethylene in solution in the solvent.

The time of reaction will depend upon, and is interrelated to, the temperature of the reaction, the choice of catalyst, and the pressure employed. In general, however, ½ to 10, usually 2 to 5 hours will complete the desired reaction.

Any mixture of two or more polymers of the esters set forth herein can be used. These mixtures can be simple mixtures of such polymers or they may be copolymers which can be prepared by polymerizing a mixture of two or more of the monomeric esters. Mixed esters derived from the reaction of single or mixed acids with a mixture of alcohols may also be used.

The ester polymers are generally prepared by polymerizing a solution of the ester in a hydrocarbon solvent such as heptane, benzene, cyclohexane or white oil at a temperature of 60° C. to 250° C. under a blanket of refluxing solvent or an inert gas such as nitrogen or carbon dioxide to exclude oxygen. The polymerization is preferably promoted with a peroxide or azo free radical initiator, such as benzoyl peroxide.

The unsaturated carboxylic acid ester can be copolymerized with an olefin. If dicarboxylic acid anhydride, such as maleic anhydride, is used, it can be polymerized with the olefin, and then esterified with alcohol. The ethylenically unsaturated carboxylic acid or derivative thereof can be reacted with an alpha-olefin, for example, $C_8$–$C_{32}$, preferably $C_{10}$–$C_{26}$, and more preferably $C_{10}$–$C_{18}$ olefin, by mixing the olefin and acid, e.g., maleic anhydride, usually in about equal molar amounts and heating to a temperature of at least about 80° C., preferably at least 125° C., in the presence of a free-radical polymerization promoter, such as benzoyl peroxide or t-butyl hydroperoxide or di-t-butyl peroxide. Other examples of copolymers are those of maleic anhydride with styrene, or cracked wax olefins, which copolymers are then usually completely esterified with alcohol, as are the other aforesaid specific examples of the olefin ester polymers.

The Hydrocarbyl-Substituted Phenol (A)(ii):

While the term "phenol" is used herein in the description of component (A)(ii), it is to be understood that such term is not intended to limit the aromatic moiety of the phenol group of component (A)(ii) to benzene. Accordingly, it is to be understood that the aromatic moiety of component (A)(ii), as represented by "Ar" in the formula I can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein at least one aromatic nucleus is fused at two points to another nucleus such as found in naphthalene, anthracene, the azanaphthalenes, etc. Alternatively, such polynuclear aromatic moieties can be of the linked type wherein at least two nuclei (either mono- or polynuclear) are linked through bridging linkages to each other. Such bridging linkages can be chosen from the group consisting of carbon-to-carbon single bonds, ether linkages, keto linkages, sulfide linkages, polysulfide linkages of 2 to 6 sulfur atoms, sulfinyl linkages, sulfonyl linkages, methylene linkages, alkylene linkages, di-(lower alkyl)-methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by both a methylene linkage and a covalent bond. Such a nucleus may be considered to have 3 nuclei but only two of them are aromatic. Normally, however, Ar will contain only carbon atoms in the aromatic nuclei per se (plus any lower alkyl or alkoxy substituent present).

The number of aromatic nuclei, fused, linked or both, in Ar can play a role in determining the integer values of a and b in formula I. For example, when Ar contains a single aromatic nucleus, a and b independently can be from 1 to 5. When Ar contains two aromatic nuclei, a and b can each be an integer of 1 to 10. With a trinuclear Ar moiety, a and b can each be an integer of 1 to 15. The value of a and b is obviously limited by the fact that their sum cannot exceed the total unsatisfied valences of Ar.

The single ring aromatic nucleus which can be the Ar moiety can be represented by the general formula $$ar(Q)_m$$

wherein ar represents a single ring aromatic nucleus (e.g., benzene) of 4 to 10 carbons, each Q independently represents a lower alkyl group, lower alkoxy group, nitro group, or halogen atom, and m is 0 to 4. Halogen atoms include fluorine, chlorine, bromine and iodine atoms; usually, the halogen atoms are fluorine and chlorine atoms.

Specific examples of single ring Ar moieties are the following:

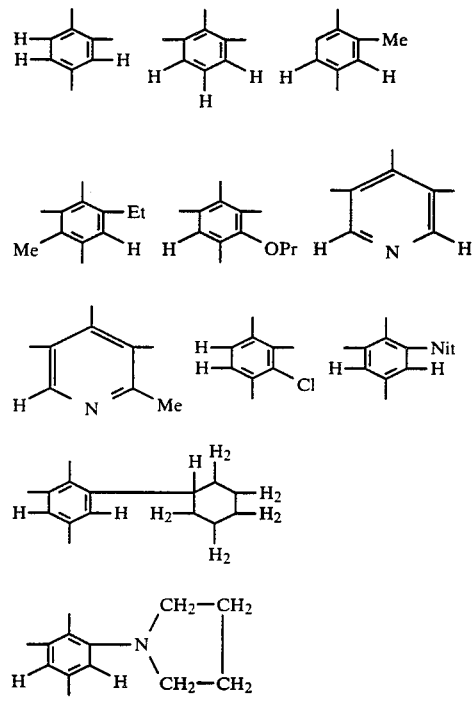

wherein Me is methyl, Et is ethyl, Pr is n-propyl, and Nit is nitro.

When Ar is a polynuclear fused-ring aromatic moiety, it can be represented by the general formula $$ar\Big\{ar\Big\}_{m'}, (Q)_{mm'}$$

wherein ar, Q and m are as defined hereinabove, m' is 1 to 4 and ⊃ represent a pair of fusing bonds fusing two rings so as to make two carbon atoms part of the rings of each of two adjacent rings. Specific examples of fused ring aromatic moieties Ar are:

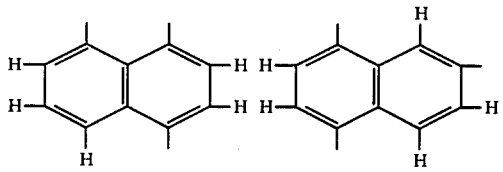

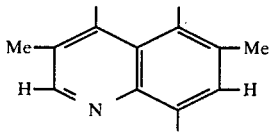

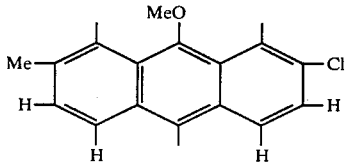

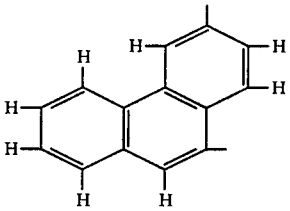

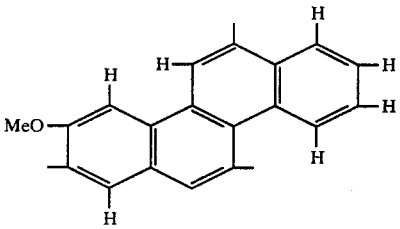

When the aromatic moiety Ar is a linked polynuclear aromatic moeity it can be represented by the general formula $$ar—(—Lng—ar—)—_w(Q)_{mw}$$

wherein w is an integer of 1 to about 20, preferably 1 to about 8, more preferably 1, 2 or 3, ar is as described above with the priviso that there are at least 2 unsatisfied (i.e., free) valences in the total of ar groups, Q and m are as defined hereinbefore, and each Lng is a bridging linkage individually chosen from the group consisting of carbon-to-carbon single bonds, ether linkages (e.g. —O—), keto linkages (e.g., $$-\overset{O}{\overset{\|}{C}}-),$$

sulfide linkages (e.g., —S—), polysulfide linkages of 2 to 6 sulfur atoms (e.g., $—S_{2—6}—$), sulfinyl linkages (e.g., —S(O)—), sulfonyl linkages (e.g., $—S(O)_2—$), lower alkylene linkages (e.g., $$—CH_2—,\ —CH_2—CH_2—,\ —\underset{\underset{R^\circ}{|}}{CH}—CH—,$$

etc.), di(lower alkyl)-methylene linkages (e.g., $CR^\circ{}_2—$), lower alkylene ether linkages (e.g., $$—CH_2O—,\ —CH_2O—CH_2—,\ —CH_2—CH_2—O—,$$

$$—CH_2CH_2OCH_2CH_2—,\ —CH_2\underset{\underset{R^\circ}{|}}{CH}OCH_2\underset{\underset{R^\circ}{|}}{CH}—$$

$$—CH_2\underset{\underset{R^\circ}{|}}{CH}O\underset{\underset{R^\circ}{|}}{CH}CH_2—,$$

etc.), lower alkylene sufide linkages (e.g., wherein one or more —O—'s in the lower alkylene ether linkages is replaced with an —S— atom), lower alkylene polysulfide linkages (e.g., wherein one or more —O—'s is replaced with a $—S_{2—6}$ group), amino linkages (e.g., $$—\underset{\underset{H}{|}}{N}—,\ —\underset{\underset{R^\circ}{|}}{N}—,\ —CH_2N—,\ —CH_2NCH_2—,\ \text{alk-N}—,$$

where alk is lower alkylene, etc.), polyamino linkages (e.g., $$—\underset{|}{N}(\underset{|}{alkN})_{1-10}$$

where the unsatisfied free N valences are taken up with H atoms or R° groups), and mixtures of such bridging linkages (each R° being a lower alkyl group). It is also possible that one or more of the ar groups in the above-linked aromatic moiety can be replaced by fused nuclei such as ar ar m'.

Specific examples of linked moieties are:

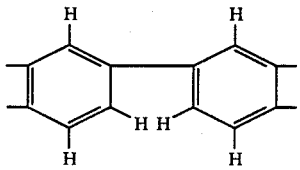

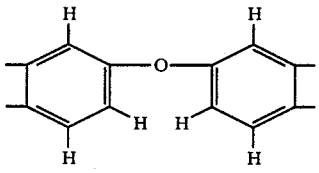

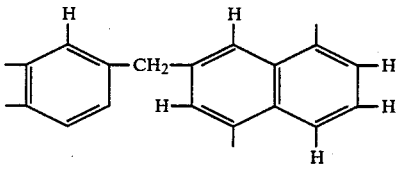

-continued

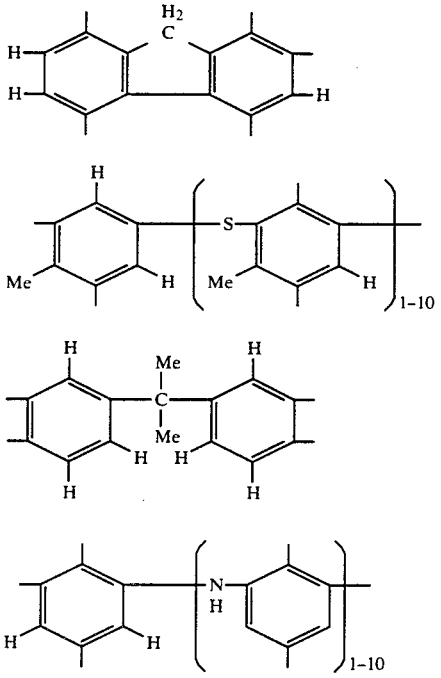

Usually all these Ar moieties are unsubstituted except for the R* and —O— groups (and any bridging groups).

For such reasons as cost, availability, performance, etc., the Ar moiety is normally a benzene nucleus, low alkylene bridged benzene nucleus, or a naphthalene nucleus.

The phenols of the present invention contain, directly bonded to the aromatic moiety Ar, at least one R* group which is a substantially saturated monovalent hydrocarbon-based polymer of at least about 30 aliphatic carbon atoms or a hydrocarbyl group of about 8 to about 30 carbon atoms. The polymer can have an average of up to about 750 aliphatic carbon groups. Usually it has an average of up to about 400 carbon atoms. In some instances the polymer has a minimum average of about 50 carbon atoms. More than one such R* group can be present, but usually no more than 2 or 3 such groups are present for each aromatic nucleus in the aromatic moiety Ar. The total number of R* groups present is indicated by the value for "a" in Formula I.

Generally, the polymerized R* groups are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The polymerized groups can also be derived from the halogenated (e.g., chlorinated or brominated) analogs of such homo- or interpolymers. The polymers can, however, be made from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly-(ethylene) greases) and other sources known to those skilled in the art. Any unsaturation in the polymerized R* groups may be reduced or eliminated by hydrogenation according to procedures known in the art before the nitration step described hereafter.

The polymerized R* groups are substantially saturated, that is, they contain no more than one carbon-to-carbon unsaturated bond for every ten carbon-to-carbon single bonds present. Usually, they contain no more than one carbon-to-carbon non-aromatic unsaturated bond for eveey 50 carbon-to-carbon bonds present.

The polymerized R* groups are also substantially aliphatic in nature, that is, they contain no more than one non-aliphatic moiety (cycloalkyl, cycloalkenyl or aromatic) group of six or less carbon atoms for every ten carbon atoms in the R* group. Usually, however, the R* groups contain no more than one such non-aliphatic group for every fifty carbon atoms, and in many cases, they contain no such non-aliphatic groups at all; that is, the typical R* groups are purely aliphatic. Typically, these purely aliphatic R* groups are alkyl or alkenyl groups.

Specific examples of the substantially saturated hydrocarbon-based R* groups are the following:

a tetracontanyl group a henpentacontanyl group a mixture of poly(ethylene/propylene) groups of an average of about 35 to about 70 carbon atoms a mixture of the oxidatively or mechanically degraded poly(ethylene/propylene) groups of an average of about 35 to about 70 carbon atoms a mixture of poly(propylene/1-hexene) groups of an average of about 80 to about 150 carbon atoms a mixture of poly(isobutene) groups have an average of between 20 and 32 carbon atoms a mixture of poly(isobutene) groups having an average of 50 to 75 carbon atoms.

A preferred source of the group R* are poly(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride. These polybutenes contain predominantly (greater than 80% of total repeat units) isobutene repeating units of the configuration

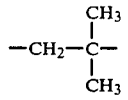

The $C_{8-30}$ mono-olefins useful in forming the R* group can be internal olefins (i.e, when the olefinic unsaturation is not in the "-1-" or alpha position) or preferably 1-olefins. These $C_{8-30}$ mono-olefins can be either straight or branched chain, but preferably they are straight chain. Exemplary of such $C_{8-30}$ mono-olefins are 1-octene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene, 1-pentacosene, 1-hexacosene, 1-octacosene, 1-nonacosene, etc. Hexadecene is preferred. Preferred $C_{8-30}$ mono-olefins are the commercially available alpha olefin mixtures such as $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, etc. Additionally, $C_{30}+$ alpha-olefin fractions such as those available from Gulf Oil Company under the name Gulftene can be used.

Mono-olefins which are useful in forming the R* group can be derived from the cracking of paraffin wax. The wax cracking process yields both even and odd number $C_{6-20}$ liquid olefins of which 85 to 90 percent are straight chain 1-olefins. The balance of the cracked wax olefins is made up of internal olefins, branched olefins, diolefins, aromatics and impurities. Distillation of the $C_{6-20}$ liquid olefins obtained from the wax cracking process yields fractions (i.e., $C_{15-18}$ alpha-olefins) which are useful in preparing the olefin polymers of this invention.

Other mono-olefins can be derived from the ethylene chain growth process. This process yields even numbered straight chain 1-olefins from a controlled Ziegler polymerization.

Other methods for preparing the mono-olefins of this invention include chlorination-dehydrochlorination of paraffin and catalytic dehydrogenation of paraffins.

The above procedures for the preparation of mono-olefins are well known to those of ordinary skill in the art and are described in detail under the heading "Olefins" in the *Encyclopedia of Chemical Technology,* Second Edition, Kirk and Othmer, Supplement, Pages 632–657, Interscience Publishers, Div. of John Wiley and Son, 1971, which is hereby incorporated by reference for its relevant disclosures pertaining to methods for preparing mono-olefins.

The attachment of the R* group to the aromatic moiety Ar of the phenols of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol. The reaction occurs in the presence of a Lewis acid catalyst (e.g., boron trifluoride and its complexes with ethers, phenols, hydrogen fluoride, etc., aluminum chloride, aluminum bromide, zinc dichloride, etc.). Methods and conditions for carrying out such reactions are well known to those skilled in the art. See, for example, the discussion in the article entitled, "Alkylation of Phenols" in "Kirk-Othmer Encyclopedia of Chemical Technology", Second Edition, Vol. 1, pages 894–895, Interscience Publishers, a division of John Wiley and Company, N.Y., 1963. Other equally appropriate and convenient techniques for attaching the R* group to the aromatic moiety Ar will occur readily to those skilled in the art.

As will be appreciated from inspection of Formula I that the phenols of this invention contain at least one of each of a hydroxyl group and a R* group as defined above. Each of the foregoing groups must be attached to a carbon atom which is a part of an aromatic nucleus in the Ar moiety. They need not, however, each be attached to the same aromatic ring if more than one aromatic nucleus is present in the Ar moiety.

In a preferred embodiment, the phenols of this invention can be represented by the formulas:

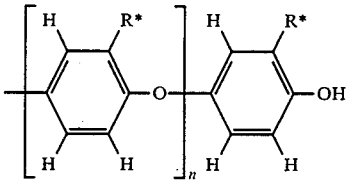

-continued

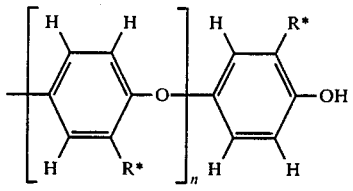

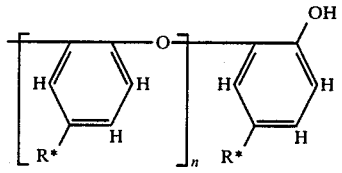

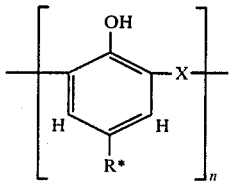

wherein n is 1 to 20, preferably 1 to 8, and more preferably 1, 2 or 3; and X is —O—, —$CH_2$—, —S—, —$S_{2-6}$—, —$CH_2$—O—$CH_2$—, or

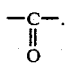

The Hydrocarbyl-Substituted Carboxylic Acylating Agents (B)(I):

The hydrocarbyl-substituted carboxylic acylating agents of the present invention are made by reacting one or more alpha-beta olefinically unsaturated carboxylic acid reagents containing two to about 20 carbon atoms, exclusive of the carboxyl-based groups, with one or more mono-olefins and/or olefin polymers containing at least 30 carbon atoms.

The alpha-beta olefinically unsaturated carboxylic acid reagents may be either the acid per se or functional derivatives thereof, e.g., anhydrides, esters, acylated nitrogen, acyl halide, nitriles, metal salts. These carboxylic acid reagents may be either monobasic or polybasic in nature. When they are polybasic they are preferably dicarboxylic acids, although tri- and tetracarboxylic acids can be used. Exemplary of the monobasic alpha-beta olefinically unsaturated carboxylic acid reagents are the carboxylic acids corresponding to the formula:

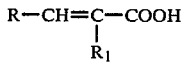

wherein R is hydrogen, or a saturated aliphatic or alicyclic, aryl, alkylaryl or heterocyclic group, preferably hydrogen or a lower alkyl group, and $R_1$ is hydrogen or a lower alkyl group. The total number of carbon atoms in R and $R_1$ should not exceed 18 carbon atoms. Specific examples of useful monobasic alpha-beta olefinically unsaturated carboxylic acids are acrylic acid, methacrylic acid, cinnamic acid, crotonic acid, 3-phenyl propenoic acid, alpha,beta-decenoic acid, etc. Exemplary polybasic acids include maleic acid, fumaric acid, mesaconic acid, itaconic acid and citraconic acid.

The alpha-beta olefinically unsaturated reagents can also be functional derivatives of the foregoing acids. These functional derivatives include the anhydrides, esters, acylated nitrogen, acid halides, nitriles and metal salts of the afore-described acids. A preferred alpha-beta olefinically unsaturated carboxylic acid reagent is maleic anhydride. Methods of preparing such functional derivatives are well known to those of ordinary skill in the art and they can be satisfactorily described by noting the reactants used to produce them. Thus, for example, derivative esters for use in the present invention can be made by esterifying monohydric or polyhydric alcohols or epoxides with any of the aforedescribed acids. Amines and alcohols described hereinafter can be used to prepare these functional derivatives. The nitrile functional derivatives of the afore-described carboxylic acid useful in making the products of the present invention can be made by the conversion of a carboxylic acid to the corresponding nitrile by dehydration of the corresponding amide. The preparation of the latter is well known to those skilled in the art and is described in detail in *The Chemistry of the Cyano Group* edited by Zvi Rappoport, Chapter 2, which is hereby incorporated by reference for its relevant disclosures pertaining to methods for preparing nitriles.

Ammonium salt acylated nitrogen functional derivatives can also be made from any of the amines described hereinafter as well as from tertiary amino analogs of them (i.e., analogs wherein the —NH groups have been replaced with —N-hydrocarbyl or —N-hydroxy hydrocarbyl groups), ammonia or ammonium compounds (e.g., $NH_4Cl$, $NH_4OH$, etc) by conventional techniques well known to those of ordinary skill in the art.

The metal salt functional derivatives of the foregoing carboxylic acid reagents can also be made by conventional techniques well known to those of ordinary skill in the art. Preferably they are made from a metal, mixture of metals, or a basically reacting metal derivative such as a metal salt or mixture of metal salts where the metal is chosen from Group Ia, Ib, IIa or IIb of the periodic table although metals from Groups IVa, IVb, Va, Vb, VIa, VIb, VIIb and VIII can also be used. The gegen ion (i.e., counter) of the metal salt can be inorganic such as halide, sulfide, oxide, carbonate, hydroxide, nitrate, sulfate, thiosulfate, phosphite, phosphate, etc., or organic such as lower alkanoic, sulfonate, alcoholate, etc. The salts formed from these metals and the acid products can be "acidic," "normal" or "basic" salts. An "acidic" salt is one in which the equivalents of acid exceed the stoichiometric amounts required to neutralize the number of equivalents of metal. A "normal" salt is one wherein the metal and acid are present in stoichiometrically equivalent amounts. A "basic" salt (sometimes referred to as "overbased," "superbased" or "hyperbased" salts) is one wherein the metal is present in a stoichiometric excess relative to the number of stoichiometric equivalents of carboxylic acid compounds from which it is produced. The production of the latter are well known to those of ordinary skill in the art and are described in detail in "Lubricant Additives" by M. W. Ranney, pages 67–77, which is hereby incorporated by reference for its relevant disclosures pertaining to methods for preparing overbased salts.

The acid halide functional derivative of the afore-described olefinic carboxylic acids can be prepared by the reaction of the acids and their anhydrides with a halogenation agent such as phosphorus tribromide, phorphorus pentachloride, or thionyl chloride. Esters can be prepared by the reaction of the acid halide with the aforesaid alcohols or phenolic compounds such as phenol, naphthol, octyl phenol, etc. Also, amides and imides and other acylated nitrogen derivatives can be prepared by reacting the acid halide with the above-described amino compounds. These esters and acylated nitrogen derivatives can be prepared from the acid halides by conventional techniques well known to those of ordinary skill in the art.

The hydrocarbyl substituents of the acylating agents (B)(I) are selected from the group consisting of (i') one or more mono-olefins of from about 8 to about 30 carbon atoms;

(ii') mixtures of one or more mono-olefins of from about 8 to about 30 carbon atoms with one or more olefin polymers of at least 30 carbon atoms selected from the group consisting of polymers of mono-1-olefins of from 2 to 8 carbon atoms, or the chlorinated or brominated analogs of such polymers; and (iii') one or more olefin polymers of at least 30 carbon atoms selected from the group consisting of (a) polymers of mono-olefins of from about 8 to about 30 carbon atoms;

(b) interpolymers of mono-1-olefins of from 2 to 8 carbon atoms with mono-olefins of from about 8 to about 30 carbon atoms;

(c) one or more mixtures of homopolymers and/or interpolymers of mono-1-olefins of from 2 to 8 carbon atoms with homopolymers and/or interpolymers of mono-olefins of from about 8 to about 30 carbon atoms; and (d) chlorinated or brominated analogs of (a), (b) or (c).

The olefin polymers are aliphatic in nature. The description of the olefin polymers as being aliphatic is intended to denote that, of the total number of carbon atoms in the polymer, no more than about 20% are nonaliphatic carbon atoms; that is, carbon atoms which are part of an alicyclic or aromatic ring. Thus, a polymer containing, e.g., 5% of its carbon atom in alicyclic ring structures and 95% of its carbon atoms in aliphatic structures would be an aliphatic polymer within the context of this invention.

Exemplary of the $C_{2-8}$ mono-1-olefins which can be used to prepare the above olefin polymers are ethylene, propylene, 1-butene, isobutene, 1-pentene, 2-methyl-1-butene, 3-methyl-1-butene, the 1-hexenes, the 1-heptenes, the 1-octenes and styrene. Preferred $C_{2-8}$ mono-1-olefins are ethylene, propylene, 1-butene, and especially isobutene.

The $C_{8-30}$ mono-olefins useful in forming the above hydrocarbyl substituents or in preparing the above olefin polymers can be internal olefins (i.e., when the olefinic unsaturation is not in the "-1-" or alpha position) or preferably 1-olefins. These $C_{8-30}$ mono-olefins can be either straight or branched chain, but preferably they are straight chain. Exemplary of such $C_{8-30}$ mono-olefins are 1-octene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene, 1-pentacosene, 1-hexacosene, 1-octacosene, 1-nonacosene, etc. Preferred $C_{8-30}$ mono-olefins are the commercially available alpha olefin mixtures such as $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{22-28}$ alpha-olefins, etc. Additionally, $C_{30}+$ alpha-olefin fractions such as those available from Gulf Oil Company under the name Gulftene can be used.

Mono-olefins which are useful in forming the hydrocarbyl substituent or in the preparation of the above olefin polymers can be derived from the cracking of paraffin wax. The wax cracking process yields both even and odd number $C_{6-20}$ *liquid olefins of which* 85 to 90 percent are straight chain 1-olefins. The balance of the cracked wax olefins is made up of internal olefins, branched olefins, diolefins, aromatics and impurities. Distillation of the $C_{6-20}$ liquid olefins obtained from the wax cracking process yields fractions (i.e., $C_{15-18}$ alpha-olefins) which are useful in preparing the olefin polymers of this invention.

Other mono-olefins can be derived from the ethylene chain growth process. This process yields even numbered straight chain 1-olefins from a controlled Ziegler polymerization.

Other methods for preparing the mono-olefins of this invention include chlorination-dehydrochlorination of paraffin and catalytic dehydrogenation of paraffins.

The above procedures for the preparation of mono-olefins are well known to those of ordinary skill in the art and are described in detail under the heading "Olefins" in the *Encyclopedia of Chemical Technology,* Second Edition, Kirk and Othmer, Supplement, Pages 632–657, Interscience Publishers, Div. of John Wiley and Son, 1971, which is hereby incorporated by reference for its relevant disclosures pertaining to methods for preparing mono-olefins.

The olefin polymers used in this invention can be interpolymers of $C_{2-8}$ mono-1-olefins with $C_{8-30}$ mono-olefins. Therefore, a mixture of one or more olefins selected from the group $C_2$, $C_3$, $C_4$, $C_5$, $C_6$, $C_7$, and $C_8$ mono-1-olefins can be polymerized with a mixture of one or more olefins selected from the group consisting of $C_8$, $C_9$, $C_{10}$, $C_{11}$, $C_{12}$, $C_{13}$, $C_{14}$, $C_{15}$, $C_{16}$, etc. up to about $C_{30}$ mono-olefins. For example, an interpolymer is prepared by polymerizing one part of a mixture of 25% ethylene, 50% isobutylene and 25% 1-octene with one part 1-dodecene. Another example would be an interpolymer prepared by polymerizing one part of isobutylene with five parts of a mixture of 31% $C_{15}$-1-olefin, 31% $C_{16}$-1-olefin, 28% $C_{17}$-1-olefin and 10% $C_{18}$-1-olefin.

The olefin polymers can also be mixtures of (a) homopolymers and/or interpolymers of $C_{2-8}$ mono-1-olefins with (b) homopolymers and/or interpolymers of $C_{8-30}$ mono-olefins. For example, a mixture of one part of the homopolymer of isobutene with two parts of an interpolymer of 20% of 1-tetradecene, 30% of 1-hexadecene, 30% of 1-octadecene and 20% of 1-eicosene is useful as the olefin polymer of this invention.

As noted above, the olefin polymers used in this invention can contain small amounts of alicyclic carbon atoms. Such alicyclic carbon atoms can be derived from such monomers as cyclopentene, cyclohexene, ethylene cyclopentane, methylene cyclohexene, 1,3-cyclohexene, norbornene, norboradiene and cyclopentadiene.

The olefin polymers used in this invention are also substantially saturated in nature. That is, their molecules contain no more than 10% olefinic or acetylenic unsaturation. In other words, there is no more than one olefinic or acetylenic carbon-carbon bond for every ten monovalent carbon-carbon bonds in the molecules of the polymers. Normally, the polymers are free from acetylenic unsaturation. For purposes of this invention it is preferred that the olefin polymers are derived from at least about 20% by weight or more of $C_{8-30}$ mono-olefins.

The olefin polymers used in this invention contain at least about 30 aliphatic carbon atoms; preferably, they contain an average of up to about 3500 carbon atoms; preferably an average of about 50 to about 700 carbon atoms. In terms of molecular weight, the polymers used in this invention have number average molecular weights as determined by gel permeation chromatography of at least about 420, more preferably, they have a maximum number average molecular weight as determined by gel permeation chromatography of no more than about 50,000; an especially preferred range for number average molecular weights of the polymers used in this invention is about 750 to about 10,000. A particularly preferred range of number average molecular weights is from about 750 to about 3,000. The preferred weight average molecular weight as determined by gel permeation chromatography is at least about 420 up to about 100,000, more preferably about 1,500 to about 20,000.

The molecular weight of the polymers used in this invention can also be defined in terms of inherent viscosity. The inherent viscosity ($n_{inh}$) of these polymers generally is at least about 0.03, preferably at least about 0.07 and being no more than about 1.5, preferably no more than 0.2 deciliters per gram. These inherent viscosities are determined at concentrations of 0.5 gram of polymer in 100 ml. carbon tetrachloride and at 30° C.

The olefin polymers of this invention are most conveniently obtained by the polymerization of the olefins with Friedel-Crafts polymerization catalyst such as aluminum chloride, boron trifluoride, titanium tetrachloride, or the like. The polymers could also be obtained by the use of "Ziegler Type" catalysts. These catalysts generally include a transition metal compound such as the halide, oxide or alkoxide and an organo-metallic compound wherein the metal is of the Group I-III of the Periodic Chart. Generally, titanium tri- or tetrachloride or vanadium trichloride or oxychloride is combined with a trialkyl or dialkyl aluminum halide such as triethyl aluminum, triisobutyl aluminum or diethyl aluminum chloride.

Additionally, the olefin polymers of this invention can be obtained by chain polymerization of the olefins by the use of free-radical initiators. The free-radical initiators commonly used are organic peroxides. The preferred organic peroxides are di-t-butyl peroxide and benzoyl peroxide. Chain polymerization is well known to those of ordinary skill in the art and is discussed more fully in Schildknecht, C. E., *Alkyl Compounds and Their Polymers,* Wiley-Interscience, 1973, pp. 62–63, which is incorporated by reference for its relevant disclosure pertaining to methods of chain polymerization and free-radical initiators useful in chain polymerization.

While not wishing to be bound by theory it is believed that it is essential that straight chain alkyl groups on the average of from about 8 to about 30, preferably from about 12 to about 24, carbon atoms comprise the monomer hydrocarbyl substituent or comprise side branches on the polymerized hydrocarbyl substituent to effectively suspend or disperse the wax crystals that form when the fuel compositions of the invention are cooled. The foregoing polymerization techniques provide for the formation of such side branches.

The hydrocarbyl substituted carboxylic acylating agents of the present invention can be prepared by directly contacting one or more alpha-beta olefinically unsaturated carboxylic reagents with one or more mono-olefins and/or olefin polymers at a temperature in the range of, for example, about 140° C. to about 300° C. The processes for preparing hydrocarbyl-substituted carboxylic acid acylating agents are well known to those of ordinary skill in the art and have been described in detail, for example, in U.S. Pat. Nos. 3,087,936; 3,163,603; 3,172,892; 3,189,544; 3,219,666; 3,231,587; 3,272,746; 3,288,714; 3,306,907; 3,331,776; 3,340,281; 3,341,542; 3,346,354; and 3,381,022 which are incorporated herein by reference.

The hydrocarbyl-substituted carboxylic acylating agent compositions of this invention can also be prepared by reacting one or more alpha-beta olefinically unsaturated carboxylic reagents with one or more mono-olefins and/or olefin polymers in the presence of chlorine or bromine at a temperature within the range of about 100° C. to about 300° C. according to the techniques disclosed in U.S. Pat. Nos. 3,215,707, 3,231,587, and 3,912,764, which are incorporated herein by reference.

The chlorinated or brominated analogs of the above olefin polymer can be prepared by conventional techniques well known to those of ordinary skill in the art. For example, the chlorinated analogs of the olefin polymers can be prepared by contacting (i.e., reacting) a 1:1 mole ratio of the olefin polymer with chlorine at 100°-200° C. Excess chlorine may be used; for example, about 1.1 to about 3 moles of chlorine for each mole of olefin polymer.

The mono-olefin and/or olefin polymer, or chlorinated or brominated analog of such polymer, is generally reacted at a ratio of one equivalent of mono-olefin and/or olefin polymer, or chlorinated or brominated analog of such polymer, (for purposes of this invention the equivalent weight of the olefin polymer is equal to its number average molecular weight, as determined by gel permeation chromatography) to from about 0.1 to about 5 moles, usually 0.1 to about 1 mole, with the unsaturated carboxylic reagent.

When the mono-olefin and/or olefin polymer and the unsaturated carboxylic reagents are reacted in the presence of chlorine or bromine, the ratios of the reactants are the same as hereinabove-described. The molar ratio of unsaturated carboxylic reagent to chlorine or bromine is generally one mole of such reagent to about 0.5 up to about 1.3 mole, usually, from about 1 up to about 1.05 mole, of chlorine or bromine.

The Amines and/or Alcohols (B)(II):

The amines useful for reacting with the hydrocarbyl-substituted carboxylic acylating agents (B)(I) of this invention are characterized by the presence within their structure of at least one

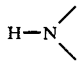

group. These amines can be monoamines or polyamines. Hydrazine and substituted hydrazines containing up to three substituents are included as amines suitable for preparing carboxylic derivative compositions. Mixtures of two or more amines can be used in the reaction with one or more of the acylating agents of the present invention. Preferably, the amine contains at least one primary amino group (i.e., —$NH_2$). Advantageously, the amine is a polyamine, especially a polyamine containing at least two H—N groups, either or both of which are primary or secondary amines. The use of polyamines result in carboxylic derivative compositions which are usually more effective as dispersant/detergent additives, than are derivative compositions derived from monoamines. Suitable monoamines and polyamines are described in greater detail hereinafter.

Alcohols which can be reacted with the hydrocarbyl-substituted carboxylic acylating agents (B)(I) of the present invention include monohydric and polyhydric alcohols. Polyhydric alcohols are preferred since they usually result in carboxylic derivative compositions which are more effective as dispersant/detergents than carboxylic derivative compositions derived from monohydric alcohols. Alcohols suitable for use in this invention are described in greater detail hereinafter.

The monoamines and polyamines useful in this invention are characterized by the presence within their structure of at least one

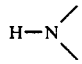

group. Therefore, they have at least one primary (i.e., $H_2N$—) or secondary amino (i.e., H—N=) group. The amines can be aliphatic, cycloaliphatic, aromatic, or heterocyclic, including aliphatic-substituted aromatic, aliphatic-substituted cycloaliphatic, aliphatic-substituted aromatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted cycloaliphatic, and heterocyclic-substituted aromatic amines and may be saturated or unsaturated. If unsaturated, the amine is preferably free from acetylenic unsaturation (i.e., —C=C—). The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as —$CH_2CH_2$—X—$CH_2CH_2$— where X is —O— or —S—).

With the exception of the branched polyalkylene polyamines, the polyoxyalkylene polyamines and the high molecular weight hydrocarbylsubstituted amines described more fully hereafter, the amines used in this invention ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent and the like. The total number of carbon atoms in these aliphatic monoamines preferably do not exceed about 40 and usually do not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamiine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenylethylamine, and 3-(furylpropyl)amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamine.

Suitable aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from maphthylene. Examples of aromatic mono-amines include aniline, di(para-methylphenyl)amine, naphthylamine, N-(n-butyl)aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

Suitable polyamines are aliphatic, cycloaliphatic and aromatic polyamines analogous to be above-described monoamines except for the presence within their structure of another amino nitrogen. The other amino nitrogen can be a primary secondary or tertiary amino nitrogen. Examples of such polyamines include N-aminopropyl-cyclohexylamines, N-N'-di-n-butyl-para-phenylene diamine, bis-(para-aminophenyl)-methane, 1,4-diaminocyclohexane, and the like.

Heterocyclic mono- and polyamines can also be used in making the substituted carboxylic acid acylating agent derivative compositions of this invention. As used herein, the terminology "heterocyclic mono- and polyamine(s)" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain heteroatoms other than nitrogen, especially oxygen and sulfur. Obviously they can contain more than one nitrogen heteroatom. The five- and six-membered heterocyclic rings are preferred.

Among the suitable heterocyclics are aziridines, azetidines, azolidines, tetra- and di-hydro pyridines, pyrroles, indoles, piperadines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and perhydroderivatives of each of the above and mixtures of two or more of these heterocycic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-di-aminoethylpiperazine.

Hydroxyamines both mono- and polyamines, analogous to those described above are also useful in this invention provided they contain at least one primary or secondary amino group. Hydroxy-substituted amines having only tertiary amino nitrogen such as in trihydroxyethyl amine, are thus excluded as an amine, but can be used as an alcohol as disclosed hereafter. The hydroxy-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanol-amine, di-(3-hydroxypropyl)-amine, 3-hydroxybutyl-amine, 4-hydroxybutylamine, diethanolamine, di-(2-hydroxypropyl)-amine, N-(hydroxypropyl)propylamine, N-(2-hydroxyethyl)-cyclohexylamine, 3-hydroxycyclopentylamine, para-hydroxyaniline, N-hydroxyethyl piperazine, and the like.

The terms hydroxyamine and aminoalcohol describe the same class of compounds and, therefore, can be used interchangeably. Hereinafter, in the specification and appended claims, the term hydroxyamine will be understood to include aminoalcohols as well as hydroxyamines.

Also suitable as amines are the aminosulfonic acids and derivatives thereof corresponding to the formula:

$$(R_cR_bN)_x(R_a)(\overset{\overset{\displaystyle O}{\|}}{\underset{\underset{\displaystyle O}{\|}}{S}}-R)_y$$

wherein R is —OH, —$NH_2$, $ONH_4$, etc., $R_a$ is a polyvalent organic radical having a valence equal to x+y; $R_b$ and $R_c$ are each independently hydrogen, hydrocarbyl, and substituted hydrocarbyl with the proviso that at least one of $R_b$ and $R_c$ is hydrogen per aminosulfonic acid molecule; x and y are each integers equal to or greater than one. From the formula, it is apparent that each aminosulfonic reactant is characterized by at least one

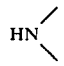

or $H_2N$— group and at least one

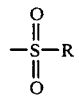

group. These sulfonic acids can be aliphatic, cycloaliphatic, or aromatic aminosulfonic acids and the corresponding functional derivatives of the sulfo group. Specifically, the aminosulfonic acids can be aromatic aminosulfonic acids, that is, where $R_1$ is a polyvalent aromatic radical such as phenylene where at least one

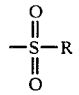

group is attached directly to a nuclear carbon atom of the aromatic radical. The aminosulfonic acid may also be a mono-amino aliphatic sulfonic acid; that is, an acid where x is one and $R_a$ is a polyvalent aliphatic radical such as ethylene, propylene, trimethylene, and 2-methylene propylene. Other suitable aminosulfonic acids and derivatives thereof useful as amines in this invention are disclosed in U.S. Pat. Nos. 3,926,820; 3,029,250; and 3,367,864; which are incorporated herein by reference.

Hydrazine and substituted-hydrazine can also be used as amines in this invention. At least one of the nitrogens in the hydrazine must contain a hydrogen directly bonded thereto. Preferably there are at least two hydrogen bonded directly to hydrazine nitrogen and, more preferably, both hydrogens are on the same nitrogen. The substituents which may be present on the hydrazine include alkyl, alkenyl, aryl, aralkyl, alkaryl, and the like. Usually, the substituents are alkyl, especially lower alkyl, phenyl, and substituted phenyl such as lower alkoxy-substituted phenyl or lower alkyl-substituted phenyl. Specific examples of substituted hydrazines are methylhydrazine, N,N-dimethylhydrazine, N,N'-dimethylhydrazine, phenyl-hydrazine, N-phenyl-N'-ethylhydrazine, N-(para-tolyl)-N'-(n-butyl)-hydrazine, N-(para-nitrophenyl)-hydrazine, N-(para-nitrophenyl)-N-methylhydrazine, N,N'-di(para-chlorophenyl)-hydrazine, N-phenyl-N'-cyclohexylhydrazine, and the like.

The high molecular weight hydrocarbyl amines, both monoamines and polyamines, which can be used as amines in this invention are generally prepared by reacting a chlorinated polyolefin having a molecular weight of at least about 400 with ammonia or amine. Such amines are known in the art and described, for example, in U.S. Pat. Nos. 3,275,554 and 3,438,757, both of which are expressly incorporated herein by reference for their disclosure in regard to how to prepare these amines. All that is required for use of these amines is that they possess at least one primary or secondary amino group.

Another group of amines suitable for use in this invention are branched polyalkylene polyamines. The branched polyalkylene polyamines are polyalkylene polyamines wherein the branched group is a side chain containing on the average at least one nitrogen-bonded aminoalkylene

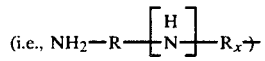

group per nine amino units present on the main chain, for example, 1–4 of such branched chains per nine units on the main chain, but preferably one side chain unit per nine main primary amino groups and at least one tertiary amino group.

These reagents may be expressed by the formula:

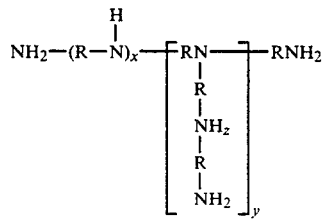

wherein R is an alkylene group such as ethylene, propylene, butylene and other homologs (both straight chained and branched), etc., but preferably ethylene; and x, y and z are integers, x being, for example, from 4 to 24 or more but preferably 6 to 18, y being, for example, 1 to 6 or more but preferably 1 to 3, and z being, for example, 0–6 but preferably 0–1. The x and y units may be sequential, alternative, orderly or randomly distributed.

The preferred class of such polyamines includes those of the formula:

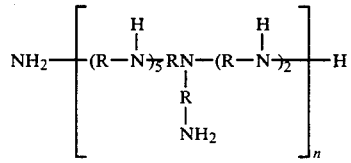

wherein n is an integer, for example, 1–20 or more but preferably 1–3, and R is preferably ethylene, but may be propylene, butylene, etc. (straight chained or branched).

The preferred embodiments are presented by the following formula:

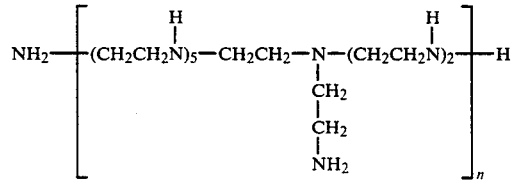

(n=1–3).

The radicals in the brackets may be joined in a head-to-head or a head-to-tail fashion. Compounds described by this formula wherein n=1–3 are manufactured and sold as Polyamines N-400, N-800, N-1200, etc. Polyamine N-400 has the above formula wherein n=1.

U.S. Pat. Nos. 3,200,106 and 3,259,578 are incorporated herein by reference for their disclosure of how to make such polyamines and processes for reacting them with carboxylic acid acylating agents.

Suitable amines also include polyoxyalkylene polyamines, e.g., polyoxyalkylene diamines and polyoxyalkylene traimines, having average molecular weights ranging from about 200 to 4000 and preferably from about 400 to 2000. Illustrative examples of these polyoxyalkylene polyamines may be characterized by the formulae:

$$NH_2\text{—Alkylene}\text{-}(\text{O-Alkylene})_m\text{-}NH_2$$

where m has a value of about 3 to 70 and preferably about 10 to 35; and $$R\text{—}[\text{Alkylene}\text{-}(\text{O—Alkylene})_n\text{-}NH_2]_{3\text{-}6}$$

wherein n is such that the total value is from about 1 to 40 with the proviso that the sum of all of the n's is from about 3 to about 70 and generally from about 6 to about 35, and R is a polyvalent saturated hydrocarbyl radical of up to ten carbon atoms having a valence of 3 to 6. The alkylene groups may be straight or branched chains and contain from 1 to 7 carbon atoms, and usually from 1 to 4 carbon atoms. The various alkylene groups present within the above formulae may be the same or different.

More specific examples of these polyamines include:

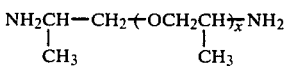

wherein x has a value of from about 3 to 70 and preferably from about 10 to 35 and:

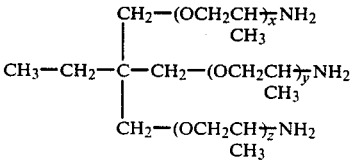

wherein x+y+z have a total value ranging from about 3 to 30 and preferably from about 5 to 10.

Preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeff-amines D-230, D-400, D-1000, D-2000, T-403, etc.".

U.S. Pat. Nos. 3,804,763 and 3,948,800 are incorporated herein by reference for their disclosure of such polyoxyalkylene polyamines and process for acylating them with carboxylic acid acylating agents.

Preferred amines are the alkylene polyamines, including the polyalkylene polyamines, as described in more detail hereafter. The alkylene polyamines include those conforming to the formula:

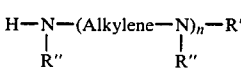

wherein n is from 1 to about 10; each R″ is independently a hydrogen atom, a hydrocarbyl group or a hydroxy-substituted hydrocarbyl group having up to about 30 atoms, and the "Alkylene" group has from about 1 to about 10 carbon atoms but the preferred alkylene is ethylene or propylene. Especially preferred are the alkylene polyamines where each R″ is hydrogen with the ethylene polyamines and mixtures of ethylene polyamines being the most preferred. Usually n will have an average value of from about 2 to about 7. Such alkylene polyamines include methylene polyamines, ethylene polyamines, butylene polyamines, propylene polyamines, pentylene polyamines, hexylene polyamines, heptylene polyamines, etc. The higher homologs of such amines and related aminoalkyl-substituted piperazines are also included.

Alkylene polyamines useful in preparing the carboxylic derivative compositions include ethylene diamine, triethylene tetramine, propylene diamine, trimethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, N-(2-aminoethyl)piperazine, 1,4-bis(2-aminoethyl)piperazine, and the like. Higher homologs as are obtained by condensing two or more of the above-illustrated alkylene amines are useful as amines in this invention as are mixtures of tw or more of any of the afore-described polyamines.

Ethylene polyamines, such as those mentioned above, are especially useful for reasons of cost and effectiveness. Such polyamines are described in detail under the heading "Diamines and Higher Amines" in *The Encyclopedia of Chemical Technology,* Second Edition, Kirk and Othmer, Volume 7, pages 27–39, Interscience Publishers, Division of John Wiley and Sons, 1965, which is hereby incorporated by reference for their disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Hydroxyalkyl alkylene polyamines having one or more hydroxyalkyl substituents on the nitrogen atoms, are also useful in preparing compositions of the present invention. Preferred hydroxyalkyl-substituted alkylene polyamines are those in which the hydroxyalkyl group is a lower hydroxyalkyl group, i.e., having less than eight carbon atoms. Examples of such hydroxyalkyl-substituted polyamines include N-(2-hydroxyethyl)ethylene diamine, N,N-bis(2-hydroxyethyl)ethylene diamine, 1-(2-hydroxyethyl)piperazine, monohydroxypropyl-substituted diethylene triamine, dihydroxypropyl-substituted etraethylene pentamine, N-(3-hydroxybutyl)tetramethylene diamine, etc. Higher homologs as are obtained by condensation of the above-illustrated hydroxy alkylene polyamines through amino radicals or through hydroxy radicals are likewise useful as amines in this invention. Condensation through amino radicals results in a higher amine accompanied by removal of ammonia and condensation through the hydroxy radicals results in products containing ether linkages accompanied by removal of water.

The carboxylic derivative compositions produced from the reaction of the hydrocarbyl-substituted carboxylic acylating agents of this invention and the amines described hereinbefore yield acylated amines which include amine salts, amides, imides and imidazolines as well as mixtures thereof. To prepare carboxylic derivatives from the acylating agents and amines, one or more acylating agents and one or more amines are heated, optionally in the presence of a normally liquid, substantially inert organic liquid solvent/diluent, at temperatures in the range of about 80° C. up to the decomposition point (the decomposition point is the temperature at which there is sufficient decomposition of any reactant or product such as to interfere with the production of the desired product) but normally at temperatures in the range of about 100° C. to about 300° C., provided 300° C. does not exceed the decomposition point. Temperatures of about 125° C. to about 250° C. are normally used. The acylating agent and the amine are reacted in amounts sufficient to provide from about one-half equivalent to about 2 moles of amine per equivalent of acylating agent. For purposes of this invention an equivalent of amine is that amount of the amine corresponding to the total weight of amine divided by the total number of nitrogens present. Thus, octylamine has an equivalent weight equal to its molecular weight; ethylene diamine has an equivalent weight equal to one-half its molecular weight; and aminoethylpiperazine has an equivalent weight equal to one-third its molecular weight. Also, for example, the equivalent weight of a commercially available mixture of polyalkylene polyamine can be determined by dividing the atomic weight of nitrogen (14) by the %N contained in the polyamine. Therefore, a polyamine mixture having a %N of 34 would have an equivalent weight of 41.2. The number of equivalents of acylating agent depends on the number of carboxylic functions (e.g., carboxylic acid groups or functional derivatives thereof) present in the acylating agent. Thus, the number of equivalents of acylating agents will vary with the number of carboxy groups present therein. In determining the number of equivalents of acylating agents, those carboxyl functions which are not capable of reacting as a carboxylic acid acylating agent are excluded. In general, however, there is one equivalent of acylating agent for each carboxy group in the acylating agents. For example, there would be two equivalents in the acylating agents derived from the reaction of one mole of olefin polymer and one mole of maleic anhydride. Conventional techniques are readily available for determining the number of carboxyl functions (e.g., acid number, saponification number) and, thus, the number of equivalents of acylating agent available to react with amine.

Because the acylating agents of this invention can be used in the same manner as the high molecular weight acylating agents of the prior art in preparing acylated amines suitable as additives for lubricating oil compositions, U.S. Pat. Nos. 3,172,892; 3,219,666; and 3,272,746 are incorporated herein by reference for their disclosures with respect to the procedures applicable to reacting the substituted carboxylic acid acylating agents of this invention with the amines as described above. In applying the disclosures of these patents to the hydrocarbyl-substituted carboxylic acylating agents of this invention, the latter can be substituted for the high molecular weight carboxylic acid acylating agents disclosed in these patents on an equivalent basis. That is, where one equivalent of the high molecular weight carboxylic acylating agent disclosed in these incorporated patents is utilized, one equivalent of the acylating agent of this invention can be used. These patents are also incorporated by reference for their disclosure of how to use the acylated amines thus produced as additives in lubricating oil compositions. Dispersant/detergent properties can be imparted to lubricating oils by incorpoarting the acylated amines produced by reacting the acylating agents of this invention with the amines described above on an equal weight basis with the acylated amines disclosed in these patents.

Alcohols useful in preparing carboxylic derivative compositions of this invention from the acylating agents previously described include those compounds of the general formula:

$$R_1—(OH)_m$$

wherein $R_1$ is a monovalent or polyvalent organic radical joined to the —OH groups through carbon-to-oxygen bonds (that is, —COH wherein the carbon is not part of a carbonyl group) and m is an integer of from 1 to about 10, preferably 2 to about 6. As with the amine reactants, the alcohols can be aliphatic, cycloaliphatic, aromatic, and heterocyclic, including aliphatic-substituted cycloaliphatic alcohols, aliphatic-substituted aromtic alcohols, aliphatic-substituted heterocyclic alcohols, cycloaliphatic-substituted aliphatic alcohols, cycloaliphatic-substituted aromatic alcohols, cycloaliphatic-substituted heterocyclic alcohols, heterocyclic-substituted aliphatic alcohols, heterocyclic-substituted cycloaliphatic alcohols, and heterocyclic-substituted aromatic alcohols. Except for the polyoxyalkylene alcohols, the mono- and polyhydric alcohols corresponding to the formula $R_1—(OH)_m$ will usually contain not more than about 40 carbon atoms and generally not more than about 20 carbon atoms. The alcohols may contain non-hydrocarbon substituents of the same type mentioned with respect to the amines above, that is, non-hydrocarbon substituents which do not interfere with the reaction of the alcohols with the acylating reagents of this invention. In general, polyhydric alcohols are preferred.

Among the polyoxyalkylene alcohols suitable for use in the preparation of the carboxylic derivative compositions of this invention are the polyoxylakylene alcohol demulsifiers for aqueous emulsions. The terminology "demulsifier for aqueous emulsions" as used herein is intended to describe those polyoxyalkylene alcohols which are capable of preventing or retarding the formation of aqueous emulsions or "breaking" aqueous emulsions. The terminology "aqueous emulsion"is generic to oil-in-water and water-in-oil emulsions.

Many commercially available polyoxyalkylene alcohol demulsifiers can be used. Useful demulsifiers are the reaction products of various organic amines, carboxylic acid amides, and quaternary ammonium salts with ethylene-oxide. Such polyoxyethylated amines, amides, and quaternary salts are available from Armour Industrial Chemical Co. under the names ETHODUOMEEN T, an ethyleneoxide condensation product of an N-alkyl alkylenediamine under the name DUOMEEN T; ETHOMEENS, tertiary amines which are ethyleneoxide condensation products of primary fatty amines; ETHOMIDS, ethyleneoxide condensates of fatty acid amides; and ETHOQUADS, polyoxyethylated quaternary ammonium salt such as quaternary ammonium chlorides.

Preferred demulsifiers are liquid polyoxyalkylene alcohols and derivatives thereof. The derivatives contemplated are the hydrocarbyl ethers and the carboxylic acid esters obtained by reacting the alcohols with various carboxylic acids. Illustrative hydrocarbyl groups are alkyl, cycloalkyl, alkylaryl, aralkyl, alkylaryl alkyl, etc., containing up to about forty carbon atoms. Specific hydrocarbyl groups are methyl, butyl, dodecyl, tolyl, phenyl, naphthyl, dodecylphenyl, p-octylphenyl ethyl, cyclohexyl, and the like. Carboxylic acids useful in preparing the ester derivatives are mono- or polycarboxylic acids such as acetic acid, valeric acid, lauric acid, stearic acid, succinic acid, and alkyl or alkenyl-substituted succinic acids wherein the alkyl or alkenyl group contains up to about twenty carbon atoms. Members of this class of alcohols are commercially available from various sources; e.g., PLURONIC polyols from Wyandotte Chemicals Corporation; POLYGLYCOL 112-2, a liquid triol derived from ethyleneoxide and propyleneoxide available from Dow Chemical Co.; and TERGITOLS, dodecylphenyl or nonylphenyl polyethylene glycol ethers, and UCONS, polyalkylene glycols and various derivatives thereof, both available from Union Carbide Corporation. However, the demulsifiers used must have an average of at least one free alcoholic hydroxyl group per molecule of polyoxyalkylene alcohol. For purposes of describing these polyoxyalkylene alcohols which are demulsifiers, an alcholic hydroxyl group is one attached to a carbon atom that does not form part of an aromatic nucleus.

In this class of preferred polyoxyalkylene alcohols are those polyols prepared as "block" copolymers. Thus, a hydroxy-substituted compound, $R_2—(OH)_q$ (where q is 1 to 6, preferably 2 to 3, and $R_2$ is the residue of a mono- or polyhydric alcohol or mono- or polyhydroxy phenol, naphtol, etc.) is reacted with an alkylene oxide,

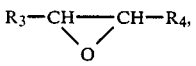

to form a hydrophobic base, $R_3$ being a lower alkyl group of up to four carbon atoms, $R_4$ being H or the same as $R_3$ with the proviso that the alkylene oxide does not contain in excess of ten carbon atoms. This base is then reacted with ethylene oxide to provide a hydrophilic portion resulting in a molecule having both hydrophobic and hydrophilic portions. The relative sizes of these portions can be adjusted by regulating the ratio of reactants, time of reaction, etc., as is obvious to those skilled in the art. It is within the skill of the art to prepare such polyols whose molecules are characterized by hydrophobic and hydrophilic moieties present in a ratio rendering them suitable as demulsifiers for aqueous emulsions in various lubricant compositions and thus suitable as alcohols in this invention. Thus, if more oil-solubility is needed in a given lubricant composition, the hydrophobic portion can be increased and/or hydrophilic portion decreased. If greater aqueous emulsion breaking capability is required, the hydrophilic and/or hydrophobic portions can be adjusted to accomplish this.

Compounds illustrative of $R_1—(OH)_q$ include aliphatic polyols such as the alkylene glycols and alkane polyols, e.g., ethylene glycol, propylene glycol, trimethylene glycol, glycerol, pentaerythritol, erythritol, sorbitol, mannitol, and the like and aromatic hydroxy compounds such as alkylated mono- and polyhydric phenols and naphthols, e.g., cresols, heptylphenols, dodecylphenols, dioctylphenols, triheptylphenols, resorcinol, pyrogallol, etc.

Polyoxyalkylene polyol demulsifiers which have two or three hydroxyl groups and molecules consisting essentially of hydrophobic portions comprising

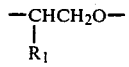

where $R_1$ is lower alkyl of up to three carbon atoms and hydrophilic portions comprising $—CH_2CH_2O—$ groups are particularly preferred. Such polyols can be prepared by first reactng a compound of the formula $R_1—(OH)_q$ where q is 2-3 with a terminal alkylene oxide of the formula

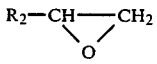

and then reacting that product with ethylene oxide. $R_1—(OH)_q$ can be, for example, TMP (trimethylolpropane), TME (trimethylolethane), ethylene glycol, trimethylene glycol, tetramethylene glycol, tri-(beta-hydroxypropyl)amine, 1,4-(2-hydroxyethyl)-cyclohexane, N,N,N',N'-tetrakis(2-hydroxypropyl)ethylene diamine, N,N,N',N'-tetrakis(2-hydroxyethyl)ethylene diamine, naphthol, alkylated naphthol, resorcinol, or one of the other illustrative examples mentioned hereinbefore.

The polyoxyalkylene alcohol demulsifiers should have an average molecular weight of 1000 to about 10,000, preferably about 2000 to about 7000. The ethyleneoxy groups (i.e., $—CH_2CH_2O—$) normally will comprise from about 5% to about 40% of the total average molecular weight. Those polyoxyalkylene polyols where he ethyleneoxy groups comprise from about 10% to about 30% of the total average molecular weight are especially useful. Polyoxylalkylene polyols having an average molecular weight of about 2500 to about 6000 where approximately 10%-20% by weight of the molecule is attributable to ethyleneoxy groups result in the formation of esters having particularly improved demulsifying properties. The ester and ether derivatives of these polyols are also useful.

Representative of such polyoxyalkylene polyols are the liquid polyols available from Wyandotte Chemicals Company under the name PLURONIC Polyols and other similar polyols. These PLURONIC Polyols correspond to the formula

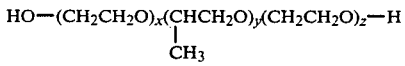

wherein x, y, and z are integers greater than 1 such that the $—CH_2CH_2O—$ groups comprise from about 10% to about 15% by weight of the total molecular weight of the glycol, the average molecular weight of said polyols being from about 2500 to about 4500. This type of polyol can be prepared by reacting propylene glycol with propylene oxide and then with ethylene oxide.

Another group of polyoxyalkylene alcohol demulsifiers illustrative of the preferred class discussed above are the commercially available liquid TETRONIC polyols sold by Wyandotte Chemicals Corporation. These polyols ae represented by the general formula:

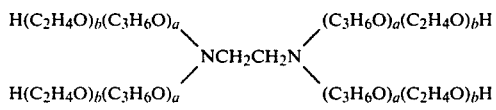

Such polyols are described in U.S. Pat. No. 2,979,528 which is incorporated herein by reference. Those polyols corresponding to the above formula having an average molecular weight of up to about 10,000 wherein the ethyleneoxy groups contribute to the total molecular weight in the percentage ranges discussed above are preferred. A specific example would be such a polyol having an average molecular weight of about 8000 wherein the ethyleneoxy groups account for 7.5%–12% by weight of the total molecular weight. Such polyols can be prepared by reacting an alkylene diamine such as ethylene diamine, propylene diamine, hexamethylene diamine etc., with propylene oxide until desired weight of the hydrophobic portion is reached. Then the resulting product is reacted with ethylene oxide to add the desired number of hydrophilic units to the molecules.

Another commercially available polyoxyalkylene polyol demulsifier falling within this preferred group is Dow Polyglycol 112-2, a triol having an average molecular weight of about 4000–5000 prepared from propylene oxides and ethylene oxides, the ethyleneoxy groups comprising about 18% by weight of the triol. Such triols can be prepared by first reacting glyccerol, TME, TMP, etc., with propylene oxide to form a hydrophobic base and reacting that base with ethylene oxide to add hydrophilic portions.

Alcohols useful in this invention also include alkylene glycols and polyoxyalkylene alcohols such as polyoxyethylene alcohols, polyoxypropylene alcohols, polyoxybutylene alcohols, and the like. These polyoxyalkylene alcohols (sometimes called polyglycols) can contain up to about 150 oxyalkylene groups and the alkylene radical contains from 2 to about 8 carbon atoms. Such polyoxyalkylene alcohols are generally dihydric alcohols. That is, each end of the molecule terminates with a —OH group. In order for such polyoxyalkylene alcohols to be useful, there must be at least one such —OH group. However, the remaining —OH group can be esterified with a monobasic, aliphatic or aromatic carboxylic acid of up to about 20 carbon atoms such as acetic acid, propionic acid, oleic acid, benzoic acid, and the like. The monoethers of these alkylene glycols and polyoxyalkylene glycols are also useful. These include the monoaryl ethers, monoalkyl ethers, and monoaralkyl ethers of these alkylene glycols and polyoxyalkylene glycols. This group of alcohols can be represented by the general formula $$HO\text{-}(R_AO)_pR_B\text{—}OR_C$$

where $R_A$ and $R_B$ are independently alkylene radicals of 2 to 8 carbon atoms; and $R_C$ is aryl such as phenyl, lower alkoxy phenyl, or lower alkyl phenyl; lower alkyl such as ethyl, propyl, tertbutyl, pentyl, etc.; and aralkyl such as benzyl, phenylethyl, phenylpropyl, p-ethylphenylethyl, etc.; p is zero to about eight, preferably two to four. Polyoxyalkylene glycols where the alkylene groups are ethylene or propylene and p is at least two as well as the monoethers thereof as described above are very useful.

The monohydric and polyhydric alcohols useful in this invention include monohydroxy and polyhydroxy aromatic compounds. Monohydric and polyhydric phenols and naphthols are preferred hydroxyaromatic compounds. These hydroxy-substituted aromatic compounds may contain other substituents in addition to the hydroxy substituents such as halo, alkyl, alkenyl, alkoxy, alkylmercapto, nitro and the like. Usually, the hydroxy aromatic compound will contain 1 to 4 hydroxy groups. The aromatic hydroxy compounds are illustrated by the following specific examples: phenol, p-chlorophenol, p-nitrophenol, beta-naphthol, alpha-naphthol, cresols, resorcinol, catechol, carvacrol, thymol, eugenol, p,p'-dihydroxy-biphenyl, hydroquinone, pyrogallol, phloroglucinol, hexyresorcinol, orcin, quaiacol, 2- chlorophenol, 2,4-dibutylphenol, propene-tetramer-substituted phenol, didodecylphenol, 4,4'-methylene-bis-methylene-bis-phenol, alpha-decyl-beta-naphthol, polyisobutenyl-(molecular weight of about 1000)-substituted phenol, the condensation product of heptylphenol with 0.5 moles of formaldehyde, the condensation product of octylphenol with acetone, di(hydroxyphenyl)oxide, di(hydroxyphenyl)sulfide, di(hydroxyphenyl)-disulfide, and 4-cyclohexylphenol. Phenol itself and aliphatic hydrocarbon-substituted phenols, e.g., alkylated phenols having up to 3 aliphatic hydrocarbon substituents are especially preferred. Each of the aliphatic hydrocarbon substituents may contain 100 or more carbon atoms but usually will have from 1 to 20 carbon atoms. Alkyl and alkenyl groups are the preferred aliphatic hydrocarbon substituents.

Further specific examples of monohydric alcohols which can be used include monohydric alcohols such as methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, monooleate of ethylene glycol, monostearate of diethylene glycol, sec-pentyl alcohol, tertbutyl alcohol, 5-bromo-dodecanol, nitro-octadecanol, and dioleate of glycerol. Alcohols useful in this invention may be unsaturated alcohols such as allyl alcohol, cinnamyl alcohol, 1-cyclohexene-3-ol and oleyl alcohol.

Other specific alcohols useful in this invention are the ether alcohols and amino alcohols including, for example, the oxyalkylene, oxyarylene-, amino-alkylene-, and amino-arylene-substituted alcohols having one or more oxyalkylene, aminoalkylene or amino-aryleneoxy-arylene radicals. They are exemplified by Cellosolve, carbitol, phenoxyethanol, heptylphenyl-(oxypropylene)$_6$—OH, octyl-(oxyethylene)$_{30}$—OH, phenyl-(oxyoctylene$_2$—OH, mono-(heptylphenyloxypropylene)-substituted glycerol, poly(styreneoxide), aminoethanol, 3-amino-ethylpentanol, di(hydroxyethyl)amine, p-aminophenol, tri(hydroxypropyl)amine, N-hydroxyethyl ethylenediamine, N,N,N',N'-tetrahydroxytrimethylenediamine, and the like.

The polyhydric alcohols preferably contain from 2 to about 10 hydroxy radicals. They are illustrated, for example, by the alkylene glycols and polyoxyalkylene glycols mentioned above such as ethylene glycol, diethylene glycol, triethylene glycol, tetraethylene glycol, dipropylene glycol, tripropylene glycol, dibutylene glycol, tributylene glycol, and other alkylene glycols and polyoxyalkylene glycols in which the alkylene radicals contain 2 to about 8 carbon atoms.

Other useful polyhydric alcohols include glycerol, monooleate of glycerol, monostearate of glycerol, monomethyl ether of glycerol, pentaerythritol, n-butyl ester of 9,10-dihydroxy stearic acid, methyl ester of 9,10-dihydroxy stearic acid, 1,2-butanediol, 2,3-hexanediol, 2,4-hexanediol, pinacol, erythritol, arabitol, sorbitol, mannitol, 1,2-cyclohexanediol, and xylene glycol. Carbohydrates such as sugars, starches, celluloses, and so forth likewise can be used. The carbohydrates may be exemplified by glucose, fructose, sucrose, rhamose, mannose, glyceraldehyde, and galactose.

Polyhydric alcohols having at least 3 hydroxyl groups, some, but not all of which have been esterified with an aliphatic monocarboxylic acid having from about 8 to 30 carbon atoms such as octanoic acid, oleic acid, stearic acid, linoleic acid, dodecanoic acid or tall oil acid are useful. Further specific examples of such partially esterified polyhydric alcohols are the monooleate of sorbitol, distearate of sorbitol, monooleate of glycerol, monostearate of glycerol, di-dodecanoate of erythritol, and the like.

A preferred class of alcohols suitable for use in this invention are those polyhydric alcohols containing up to about 12 carbon atoms, and especially those containing three to ten carbon atoms. This class of alcohols includes glycerol, erythritol, pentaerythritol, dipentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4,-hexanetriol, 1,2,3-butanetriol, 1,2,4-butanetriol, quinic acid, 2,2,6,6-tetrakis-(hydroxymethyl)cyclohexanol, 1,10-decanediol, digitalose, and the like. Aliphatic alcohols containing at least three hydroxyl groups and up to ten carbon atoms are particularly preferred.

Another preferred class of polyhydric alcohols for use in this invention are the polyhydric alkanols containing three to ten carbon atoms and particularly, those containing three to six carbon atoms and having at least three hydroxyl groups. Such alcohols are exemplified by glycerol, erythritol, pentaerythritol, mannitol, sorbitol, 2-hydroxymethyl-2-methyl-1,3-propanediol(trimethylolethane), 2-hydroxymethyl-2-ethyl-1,3-propanediol(trimethylpropane), 1,2,4-hexanetriol, and the like.

The amines useful in accordance with the present invention may contain alcoholic hydroxy substituents and alcohols that are useful can contain primary, secondary, or tertiary amino substituents. Thus, hydroxyamines can be categorized as both amine and alcohol provided they contain at least one primary or secondary amino group. If only tertiary amino groups are present, the amino alcohol belongs only in the alcohol category. Typically, the hydroxyamines are primary, secondary or tertiary alkanol amines or mixtures thereof. Such amines can be represented, respectively by the formulae:

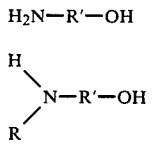

and

-continued

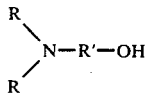

wherein each R is independently a hydrocarbyl group of one to about eight carbon atoms or hydroxyl-substituted hydrocarbyl group of two to about eight carbon atoms and R′ is a divalent hydrocarbyl group of about two to about 18 carbon atoms. The group —R′—OH in such formulae represents the hydroxyl-substituted hydrocarbyl group. R′ can be an acyclic, alicyclic or aromatic group. Typically, it is an acyclic straight or branched alkylene group such as an ethylene, 1,2-propylene, 1,2-butylene, 1,2-octadecylene, etc. group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such hetrocyclic amines include N-(hydroxyl lower alkyl)-morpholines, -thiomorpholines, -piperidines, -oxazolidines, -thiazolidines and the like. Typically, however, each R is a lower alkyl group of up to 7 carbon atoms.

The hydroxyamines can also be ether N-(hydroxyl-substituted hydrocarbyl)amines. These are hydroxyl-substituted poly(hydrocarbyloxy) analogs of the above-described hydroxy amines (these analogs also include hydroxyl-substitited oxyalkylene analogs). Such N-(hydroxyl-substituted hydrocarbyl)amines can be conveniently prepared by reaction of epoxides with aforedescribed amines and can be represented by the formulae:

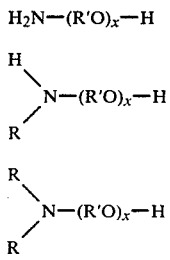

wherein x is a number from 2 to about 15 and R and R′ are as described above.

Polyamine analogs of these hydroxy amines, particularly alkoxylated alkylene polyamines (e.g., N,N-(diethanol)-ethylene diamine) can also be used in accordance with the present invention. Such polyamines can be made by reacting amines (e.g., ethylenediamine) with one or more alkylene oxides (e.g., ethylene oxide, octadecene oxide) of two to about 20 carbons. Similar alkylene oxide-alkanol amine reaction products can also be used such as the products made by reacting the aforedescribed primary, secondary or tertiary alkanol amines with ethylene, propylene or higher epoxides in a 1:1 or 1:2 molar ratio. Reactant ratios and temperatures for carrying out such reactions are known to those skilled in the art.

Specific examples of alkoxylated alkylene polyamines include N-(2-hydroxyethyl)ethylene diamine, N,N-bis(2-hydroxyethyl)-ethylene diamine, 1-(2-hydroxyethyl)piperazine, mono(hydroxypropyl)-substituted diethylene triamine, di(hdroxypropyl)-substituted tetraethylene pentamine, N-(3-hydroxybutyl)-tetramethylene diamine, etc. Higher homologs obtained by condensation of the above-illustrated hydroxy alkylene polyamines through amino radicals or through hydroxy radicals are likewise useful. Condensation through amino radicals results in a higher amine accompanied by removal of ammonia while condensation through the hydroxy radicals results in products containing ether linkages accompanied by removal of water. Mixtures of two or more of any of the aforedescribed mono- or polyamines are also useful.

Particularly useful examples of N-(hydroxyl-substituted hydrocarbyl)amines include mono-, di-, and triethanol amine, diethylethanol amine, di-(3-hydroxyl propyl)amine, N-(3-hydroxyl butyl)amine, N-(4-hydroxyl butyl)amine, N,N-di-(2-hydroxyl propyl)amine, N-(2-hydroxyl ethyl)morpholine and its thio analog, N-(2-hydroxyl ethyl)cyclohexyl amine, N-3-hydroxyl cyclopentyl amine, o-, m- and p-aminophenol, N-(hydroxyl ethyl)piperazine, N,N'-di(hydroxyl ethyl)-piperazine, and the like. Preferred hydroxy amines are diethanolamine and triethanolamine.

Further amino alcohols are the hydroxy-substituted primary amines described in U.S. Pat. No. 3,576,743 by the general formula $$R_a—NH_2$$

where $R_a$ is a monovalent organic radical containing at least one alcoholic hydroxy group, according to this patent, the total number of carbon atoms in $R_a$ will not exceed about 20. Hydroxy-substituted aliphatic primary amines containing a total of up to about 10 carbon atoms are particularly useful. Especially preferred are the polyhydroxy-substituted alkanol primary amines wherein there is only one amino group present (i.e., a primary amino group) having one alkyl substituent containing up to 10 carbon atoms and up to 6 hydroxyl groups. These alkanol primary amines correspond to $R_a—NH_2$ wherein $R_a$ is a mono-0 or polyhydroxy-substituted alkyl group. It is desirable that at least one of the hydroxyl groups to be a primary alcoholic hydroxyl group. Trismethylolaminomethane is a particularly preferable hydroxy-substituted primary amine. Specific examples of the hydroxy-substituted primary amines include 2-amino-1-butanol, 2-amino-2-methyl-1-propanol, p-(beta-hydroxyethyl)-analine, 2-amino-1-propanol, 3-amino-1-propanol, 2-amino-2-methyl-1,3-propanediol, 2-amino-2-ethyl-1,3-propanediol, N-(beta-hydroxypropyl)-N'-(beta-aminoethyl)-piperazine, tris(-hydroxymethyl)amino methane (also known as trismethylolamino methane), 2-amino-1-butanol, ethanolamine, beta-(beta-hydroxy ethoxy)-ethyl amine, glucamine, glusoamine, 4-amino-3-hydroxy-3-methyl-1-butene (which can be prepared according to procedures known in the art by reacting isopreneoxide with ammonia), N-3-(aminopropyl)-4-(2-hydroxyethyl)-piperadine, 2-amino-6-methyl-6-heptanol, 5-amino-1-pentanol, N-(beta-hydroxyethyl)-1,3-diamino propane, 1,3-diamino-2-hydroxypropane, N-(beta-hydroxy ethoxyethyl)-ethylenediamine, and the like. For further description of the hydroxy-substituted primary amines contemplated as being useful as amines and/or alcohols, U.S. Pat. No. 3,576,743 is incorporated herein by reference for its disclosure of such amines.

The carboxylic derivative compositions produced by reacting the acylating reagents of this invention with alcohols are esters. Both acidic esters and neutral esters are contemplated as being within the scope of this invention. Acidic esters are those in which some of the carboxylic acid functions in the acylating reagents are not esterified but are present as free carboxyl groups. Obviously, acid esters are easily prepared by using an amount of alcohol insufficient to esterify all of the carboxyl groups in the acylating reagents of this invention.

The acylating agents of this invention are reacted with the alcohols according to conventional esterification techniques. It normally involves heating the acylating agent of this invention with the alcohol, optionally in the presence of a normally liquid, substantially inert, organic liquid solvent/diluent and/or in the presence of esterification catalyst. Temperatures of at least about 100° C. up to the decomposition point are used (the decomposition point having been defined hereinbefore). This temperature is usually within the range of about 100° C. up to about 300° C. with temperature of about 140° C. to 250° C. often being employed. Usually, at least about one-half equivalent of alcohol is used for each equivalent of acylating agent. An equivalent of acylating reagent is the same as discussed above with respect to reaction with amines. An equivalent of alcohol is its molecular weight divided by the total number of hydroxyl groups present in the molecule. Thus, an equivalent weight of ethanol is its molecular weight while the equivalent weight of ethylene glycol is one-half its molecular weight. The amino-alcohols have equivalent weights equal to the molecular weight divided by the total number of hydroxy groups and nitrogen atoms present in each molecule.

Many issued patents disclose procedures for reacting high molecular weight carboxylic acid acylating agents with alcohols to produce acidic esters and neutral esters. These same techniques are applicable to preparing esters from the acylating agents of this invention and the alcohols described above. All that is required is that the acylating agents of this invention are substituted for the high molecular weight carboxylic acid acylating reagents discussed in these patents, usually on an equivalent weight basis. The following U.S. Patents are expressly incorporated herein by reference for their disclosure of suitable methods for reacting the acylating reagents of this invention with the alcohols described above: U.S. Pat. Nos. 3,331,776; 3,381,022; 3,522,179; 3,542,680; 3,697,428; 3,755,169.

Suitable substantially inert, organic liquid solvents or diluents may be used in the reaction processes of the present invention and include such relatively low boiling liquids as hexane, heptane, benzene, toluene, xylene, etc., as well as high boiling materials such as solvent neutral oils, bright stocks, and various types of synthetic and natural lubricating oil base stocks. Factors governing the choice and use of such materials are well known to those of skill in the art. Normally such diluents will be used to facilitate heat control, handling, filtration, etc. It is often desirable to select diluents which will be compatible with the other materials, which are to be present in the environment where the product is intended to be used.

As used in the specification and appended claims, the term "substantially inert" when used to refer to solvents, diluents, and the like, is intended to mean that the solvent, diluent, etc., is inert to chemical or physical change under the conditions in which it is used so as not to materially interfere in an adverse manner with the preparation, storage, blending and/or functioning of the compositions, additives, compounds, etc., of this invention in the context of its intended use. For example, small amounts of a solvent, diluent, etc., can undergo minimal reaction or degradation without preventing the making and using of the invention as described herein. In other words, such reaction or degradation, while technically discernible, would not be sufficient to deter the practical worker of ordinary skill in the art from making and using the invention for its intended purposes. "Substantially inert" as used herein is, thus, readily understood and appreciated by those of ordinary skill in the art.

As previously described, substantially inert organic liquid solvents or diluents may be used in this reaction. The compositions of this invention can be recovered from such solvent/diluents by such standard procedures as distillation, evaporation, and the like when desired. Alternatively, if the solvent/diluent is, for example, a base suitable for use in a functional fluid, the product can be left in the solvent/diluent and used to form the lubricating, fuel or functional fluid composition as described below. The reaction mixture can be purified by conventional means (e.g., filtration, centrifugation, etc.), if desired.

The aforesaid invention is illustrated by the following specific examples. In these examples, as well as elsewhere in the specification and appended claims, all percentages and parts are by weight (unless otherwise stated expressly to the contrary) and the molecular weights are number average molecular weights (Mn) as determined by gel permeation chromatography (GPC).

EXAMPLE 1

A mixture of 660 parts of n-hexane and 25 parts of aluminum chloride is cooled to −20° C. To this mixture is added a mixture cooled to −15° C. of 1090 parts of isobutylene and 1090 parts of a commercial $C_{16-18}$ alpha-olefin available from Gulf Oil Company. The solution is added slowly over a two-hour period and the reaction mixture is maintained at −10° C. After the addition is complete the reaction mixture is held at −10° C. for two hours and then allowed to warm up to room temperature. At room temperature 40 parts of aqueous ammonium hydroxide solution is added to the reaction mixture and then stirred for two hours. The reaction mixture is filtered through diatomaceous earth and the filter pad is washed with toluene. The filtrate is stripped at 250° C. under vacuum to yield the residue as the desired polymer product ($n_{inh}$=0.064 (0.5 grams/100 ml. $CCl_4$, 30° C.)).

EXAMPLE 2

A mixture of 1600 parts of the polymer prepared in Example 1 and 153 parts of maleic anhydride is heated to 195° C. At 195° to 205° C., 119 parts of chlorine is bubbled into the reaction mixture over a 7.5-hour period. The reaction is then blown with nitrogen for 1.5 hours at 200° C. The residue is the desired acylating agent (ASTM D-94 saponification number=56).

EXAMPLE 3

A mixture of 700 parts (0.7 equivalent) of the acylating agent prepared in Example 2, 175 parts of xylene and 56 parts (1.3 equivalents) of a commercially available mixture of ethylene polyamines containing about 34% nitrogen, having an average of 3–10 nitrogen atoms per molecule is heated at reflux for seven hours. During the reflex period 11 parts of water is removed from the reaction mixture by the use of a Dean-Stark trap. Mineral oil (492 parts) is added and the mixture is filtered to yield an oil-containing solution of the desired acylated nitrogen product.

EXAMPLE 4

A mixture of 1336 parts of methylene chloride and 40 parts of aluminum chloride is cooled to −10° C. To this mixture is added a solution cooled to −10° C. of 1000 parts of isobutylene and 1000 parts of a commercial $C_{16-18}$ alpha-olefin available from Gulf Oil Company. The solution is added slowly over a two-hour period and the reaction mixture is maintained at −10° to 5° C. After the addition is complete, 60 parts of aqueous ammonium hydroxide solution is added to the reaction mixture and then allowed to warm up to room temperature. The reaction mixture is filtered through diatomaceous earth and the filter pad is washed with methylene chloride. The filtrate is stripped at 220° C. under vacuum to yield the residue as the desired polymer product ($n_{inh}$=0.126).

EXAMPLE 5

A mixture of 1390 parts of the polymer prepared in Example 4 and 120 parts of maleic anhydride is heated to 195° C. At 195°–205° C., 96 parts of chlorine is bubbled into the reaction mixture over a 7.5-hour period. The reaction mixture is blown with nitrogen for two hours at 190° C. to remove unreacted maleic anhydride. The residue is the desired acylating agent (ASTM D-94 saponification number=71.4).

EXAMPLE 6

A mixture of 1250 parts (1.6 equivalents) of the acylating agent prepared in Example 5, 104 parts of a commercially available mixture of ethylene polyamines containing about 32% nitrogen and having an average of 3–10 nitrogen atoms per molecule, and 200 parts of xylene is heated at reflux for seven hours. During the reflux period 17 parts of water are removed from the reaction mixture by the use of a Dean-Stark trap. To the reaction mixture is added 888 parts of mineral oil and it is filtered to yield an oil solution of the desired acylated nitrogen compound.

EXAMPLE 7

A mixture of 630 parts of a commercial $C_{18-24}$ olefins available from Ethyl Corporation, 660 parts of n-heptane and 10 parts of aluminum chloride is cooled to 0° C. by means of a dry-ice-acetone bath. At 0°–5° C., 1260 parts of gaseous isobutylene is bubbled into the reaction mixture. During the isobutylene addition, three additional two-gram portions of aluminum chloride are added. After the addition is complete, 20 ml. of methanol, followed by 30 ml. of ammonium hydroxide is added. The reaction mixture is stirred for two hours, then filtered and stripped to 250° C. under vacuum to yield the desired polymer ($n_{inh}$=0.067).

EXAMPLE 8

At 205° C. and over a 2.5-hour period, 85 parts of chlorine is bubbled into the mixture of 1084 parts of the polymer prepared in Example 7 and 106 parts of maleic anhydride. The reaction mixture is then stirred at 205° C. for 3.5 hours, followed by nitrogen blowing for 1.5 hours at 205° C. to remove HCl and other volatiles. The residue is the desired acylating agent (ASTM D-94 saponification number=88).

EXAMPLE 9

A mixture 891 parts (1.4 equivalents) of the acylating agent prepared in Example 8 and 95.4 parts of pentaerythritol is heated at 210° C. for 7.5 hours with water being removed continuously by nitrogen blowing. To the reaction mixture is added 787 parts of mineral oil and it is then filtered to yield an oil-containing solution of the desired ester product.

EXAMPLE 10

A mixture of 900 parts of a commercial $C_{16-18}$ alpha-olefin available from Gulf Oil Company and 100 parts of styrene is added to a mixture of 20 parts of aluminum chloride and 198 parts of n-hexane at 20° C. The reaction mixture is maintained at 20° C. during this addition and then allowed to stir for one hour after the addition is complete. To the reaction mixture is added 30 parts of ammonium hydroxide. The reaction mixture is filtered and stripped of solvents. The desired copolymer is obtained by distilling the reaction mixture at 240° C. and 0.05 ml. of mercury. The desired polymer has an inherent viscosity equal to 0.052.

EXAMPLE 11

At 195°-205° C., 38 parts of chlorine is bubbled into the mixture of 440 parts of the polymer prepared in Example 10 and 43 parts of maleic anhydride over a seven-hour period. The reaction mixture is then blown with nitrogen at 195° C. for two hours. The residue is the desired acylating agent.

EXAMPLE 12

A mixture of 412 parts (0.34 equivalent) of the acylating agent prepared in Example 11, 100 parts of xylene and 35 parts (0.81 equivalent) of a commercially available mixture of ethylene polyamine containing about 32% nitrogen and having an average of 3-10 nitrogen atoms per molecule is heated at reflux for eight hours. The reaction mixture is stripped to 175° C., then 294 parts of mineral oil is added. The reaction mixture is filtered to yield the desired product as an oil-containing solution of the desired acylated nitrogen product.

EXAMPLE 13

A mixture of 600 parts of a commercial $C_{18-26}$ olefin available from Ethyl Corporation and 660 parts of n-heptane is cooled to 0° C. in a dry ice-aetone bath. To the mixture is added 19 parts of aluminum chloride, followed by the addition of 1200 parts of gaseous isobutylene. After the addition is complete the reaction mixture is stirred for eight hours at 0°-5° C. Then eight parts of methanol and 30 parts of aqueous ammonium hydroxide are added and the reaction mixture is stirred for two hours. The reaction mixture is filtered through diatomaceous earth and then stripped to 280° C. under vacuum to yield the desired polymer ($n_{inh}$=0.066).

EXAMPLE 14

A mixture of 993 parts of the polymer prepared in Example 13 and 98 parts of maleic anhydride is heated to 190° C. At 200°-205° C., 71 parts of chlorine is bubbled into the reaction mixture over a seven-hour period. The reaction mixture is then blown with nitrogen for one hour at 200° C. The residue is the desired acylating agent having an ASTM D-94 saponification number of 78.

EXAMPLE 15

A mixture of 998 parts (1.38 equivalents) of the acylating agent prepared in example 14 and 123 parts of pentaerythritol is heated at 210° C. for 7.5 hours with water being removed continuously by nitrogen blowing. To the reaction mixture is added 890 parts of mineral oil and itr is then filtered to yield an oil-containing solution of the desired ester product.

EXAMPLE 16

A mixture of 1500 parts of the ester product prepared in example 15, 14 parts of a commercially available mixture of ethylene polyamine containing about 32% nitrogen and having an average of three to ten nitrogen atoms per molecule, and 200 parts of xylene is heated at reflux for ten hours. The reaction mixture is filtered to yield the desired ester-amide product.

EXAMPLE 17

At 120° C., 268 parts of di-t-butyl peroxide is added slowly to 5357 parts of a commercially available $C_{15-18}$ alpha-olefin. The reaction mixture is maintained at 130° C. for 24 hours. The reaction mixture is then stripped at 205° C. under vacuum to yield the desired polymer ($n_{inh}$=0.085).

EXAMPLE 18

A mixture of 1000 parts of the polymer prepared in Example 17, 500 parts of polybutene (Mn=1000) prepared according to conventional procedures using aluminum chloride catalyst and 98 parts of maleic anhydride is heated at 210°-240° C. for 16 hours. During the last two hours of the heating period unreacted maleic anhydride is removed by nitrogen blowing. The residue is the desired acylating agent.

EXAMPLE 19

A mixture of 500 parts of the polymer prepared in Example 17, 400 parts of polypropylene (Mn=830) which is commercially available from Amoco Chemicals Corporation under the name AMOPOL C-60 and 75 parts of maleic anhydride are reacted according to the procedure described in Example 18.

EXAMPLE 20

The procedure for Example 3 is repeated except the acylating agent prepared in Example 2 is replaced on an equal weight basis by the acylating agent prepared in Example 18.

EXAMPLE 21

The procedure for Example 9 is repeated except the acylating agent prepared in Example 8 is replaced on an equal weight basis by the acylating agent prepared in Example 20.

EXAMPLE 22

A mixture of 1200 parts of the ester prepared in Example 15, 19 parts of aminopropyl morpholine and 175 parts of xylene is heated at reflux for eight hours. A Dean-Stark trap is used to remove water during the reflux period. The reaction mixture is then stripped of solvent and filtered to yield the desired product.

EXAMPLE 23

A mixture of 900 parts (0.9 equivalent) of the acylating agent prepared in Example 2, 175 parts of xylene and 46 parts of N,N-dimethylaminopropyl amine is heated at reflux for seven hours. During the reflux period water is removed from the reaction mixture by the use of a Dean-Stark trap. To the reaction mixture is added 640 parts of mineral oil, then filtered to yield an oil-containing solution of the desired acylated nitrogen product.

EXAMPLE 24

A mixture of 670 parts of methylene chloride and 20 parts of aluminum bromide is cooled to −5° C. To this mixture is added dropwise over a period of six hours a mixture of 100 parts of $C_8$ alpha-olefin, 100 parts of $C_{12}$ alpha-olefin, 100 parts of $C_{14}$ alpha-olefin, 100 parts of $C_{16}$ alpha-olefin, and 100 parts of $C_{18}$ alpha-olefin. The reaction mixture is then warmed to room temperature and stirred for 18 hours. The catalyst is then destroyed by the addition of 50 parts of isopropanol, then diluted with 600 parts of toluene and filtered. The filtrate is washed four times with water, one time with 10% sodium hydroxide solution and one more time with water; then dried over sodium sulfate; filtered and stripped to 240° C. under vacuum to yield the desired polymer ($n_{inh}$=0.075).

EXAMPLE 25

The procedure for Example 2 is repeated except the polymer prepared in Example 1 is replaced on an equal weight basis by the polymer prepared in Example 24.

EXAMPLE 26

The procedure for Example 3 is repeated except the acylating agent prepared in Example 2 is then replaced on an equivalent basis by the acylating agent prepared in Example 25.

EXAMPLE 27

A mixture of 1719 parts of the chloride of the polymer product of Example 1, prepared by the addition of 119 parts of gaseous chlorine to 1600 parts of the polymer prepared in Example 1 at 80° C. in two hours, and 153 parts of maleic anhydride is heated to 200° C. in 0.5 hour. The reaction mixture is held at 200°-225° C. for six hours, stripped at 210° C. under vacuum and filtered. The filtrate is the desired polymer substituted succinic acylating agent.

EXAMPLE 28

The procedure for Example 3 is repeated except the acylating agent prepared in Example 2 is replaced on an equivalent basis by the acylating agent prepared in Example 27.

EXAMPLE 29

A mixture of 1000 parts of n-hexane and 190 parts of aluminum chloride is cooled to a temperature of −5° to −10° C. 6390 parts of a commercial $C_{15-18}$ alpha-olefin is added dropwise to the mixture over a period of four to six hours. The mixture is maintained at a temperature of −5° to −10° C. for one hour with stirring. 170 parts of an aqueous solution of sodium hydroxide is added dropwise to the mixture to deactivate the catalyst. The mixture is filtered. The filtrate is stripped to yield the residue as the desired polymer prouct ($n_{inh}$=0.060 (1.0 grams/100 ml. $CCl_4$, 30° C.)).

EXAMPLE 30

A mixture of 4862 parts of the polymer prepared in Example 29 and 292 parts of maleic anhydride is heated to 180° C. At 180° C. to 200° C., chlorine is bubbled into the mixture over an eight-hour period. The mixture is then blown with nitrogen for one hour at 180° C. The residue is the desired acylating agent.

EXAMPLE 31

A mixture of 4352 parts of the acylating agent prepared in Example 30 and 1088 parts of diluent oil are heated to 160° C. 92.2 parts aminopropylmorpholine and 33.0 parts diethylenetetramine are premixed and then added to the reaction mixture dropwise under a thin stream of nitrogen. The mixture is maintained at 160° to 170° C. for a total of two hours including the period provided for amine addition. The mixture is filtered and the filtrate is the desired product.

EXAMPLE 32

A mixture of 2175 parts methylene chloride and 90 parts aluminum chloride is cooled to −5° C. A mixture of 3000 parts of a commercial 1-dodecene available from Gulf Oil Company, 31.2 parts t-butyl chloride and 2175 parts methylene chloride is premixed and added dropwise to the mixture of methylene chloride and aluminum chloride over a period of five hours. After the addition is complete, the reaction mixture is maintained at −5° C. for one hour. 100 parts sodium hydroxide is added to the reaction mixture dropwise to deactivate the catalyst. The reaction mixture is filtered and stripped. The residue is the desired polymer prouct ($n_{inh}$=0.18 (0.5 grams/100 ml. $CCl_4$, 30° C.)).

EXAMPLE 33

A mixture of 1700 parts of the polymer prepared in Example 32 and 55 parts of maleic anhydride is heated to 170° C. At 170° to 190° C., chlorine is bubbled into the reaction mixture over a period of nine hours. The reaction mixture is then blown with nitrogen for one hour at 190° C. The residue is the desired acylating agent.

EXAMPLE 34

A mixture of 975 parts of the acylating agent prepared in Example 33 and 1218 parts of diluent oil are heated to 160° C. A mixture of 20.5 parts aminopropylmorpholine and 10.7 parts of pentaethylenehexamine is premixed and added to the reaction mixture over a period of 30 minutes under a thin stream of nitrogen. After addition of the amines, the reaction mixture is heated at 160° C. for one hour under a thin stream of nitrogen. The reaction mixture is filtered. The filtrate is the desired product.

EXAMPLE 35

At 120° C., 268 parts of di-t-butyl peroxide is added slowly to 5357 parts of a commercially available $C_{15-18}$ alpha-olefin. The reaction mixture is maintained at 130° C. for 24 hours. The reaction mixture is then stripped at 205° C. under vacuum to yield the desired polymer ($n_{inh}$=0.085).

EXAMPLE 36

A mixture of 1329 parts of an acylating agent made from a 1:1 molar ratio of maleic anhydride and a commercial $C_{18-24}$ alpha-olefin available from Ethyl Corporation, 220 parts xylene and 363 parts of trishydroxyethylaminoethane is heated to 135° C. and maintained at that temperature for four hours. The reaction mixture is heated to 180° C. for one-half hour during which time 85 parts of water are removed. The reaction mixture is stripped at 165°-180° C. and 22-32 mm Hg. to remove the xylene and about six parts of water. The reaction mixture is filtered using diatomaceous earth to yield the desired product.

EXAMPLE 37

A mixture of 788 parts of an acylating agent made from a 1:1 molar ratio of maleic anhydride and a commercial $C_{18-24}$ alpha-olefin available from Ethyl Corporation, and 33 parts kerosene is heated to 25° C. 210 parts of diethanolamine is added to the reaction mixture at 25° C. to 61° C., the addition being exothermic. The reaction mixture is heated to 150° C. over a five-hour period while removing water, and then held at 150° C. for six hours until the acid number drops below 40. A nitrogen sparge is used to maintain reflux. The reaction mixture is filtered in diatomaceous earth to obtain the desired product.

EXAMPLE 38

A mixture of 863 parts of an acylating agent prepared from a 1:1 molar ratio of maleic anhydride and a commercial $C_{18-24}$ alpha-olefin available from Ethyl Corporation, and 863 parts of an aromatic solvent are heated to 25° C. 210 parts of diethanolamine is added to the reaction mixture, the addition being exothermic. The reaction mixture is heated to 150° C. and maintained at that temperature until the acid number drops to 30. A nitrogen sparge is used to maintain reflux. The reaction mixture is filtered with diatomaceous earth to obtain the desired product.

EXAMPLE 39

A mixture of 5365 parts of a commercial $C_{16-18}$ alpha-olefin available from Gulf Oil Company and 108 parts of di-t-butyl peroxide is heated to 130° C. for 4 hours. 54 parts of di-t-butyl peroxide are added to the reaction mixture which is maintained at 130° C. 54 part samples of di-t-butyl peroxide are added to the reaction mixture seven more times at two-hour intervals between each addition. The reaction mixture is heated to 150° C. for one hour. The resulting product is a polymer of $C_{16-18}$ alpha-olefins ($n_{inh}$=0.063 (0.5 grams/100 ml. $CCl_4$, 30° C.)).

EXAMPLE 40

A mixture of 1800 parts of the polymer prepared in Example 39 and 211 parts of maleic anhydride is heated to 190° C. The reaction mixture is maintained at 190°-235° C. for 20 hours. The reaction mixture is blown with nitrogen at 230° C. to remove unreacted maleic anhydride.

EXAMPLE 41

A mixture of 4800 parts of polyisobutylene with a number average molecular weight of 300 and 1568 parts of maleic anhydride are heated at 220° C. to 240° C. for 30 hours. The reaction mixture is vacuum distilled at 300°-320° C. and 0.4-0.7 mm. Hg. to yield the desired product.

EXAMPLE 42

A mixture of 800 parts of the product of Example 40, 89 parts of the product of Example 41, 92.4 parts of ethylene polyamine with a nitrogen content of 32.3%, and 264 parts xylene are heated at the reflux of xylene for 5 hours. Xylene is gradually removed until the temperature reaches 170° C. The temperature is maintained at 170° C. for two hours. The mixture is diluted with toluene. A solvent refined 100 neutral oil is added and the mixture is filtered to yield an oil-containing solution of 60% of the desired nitrogen-containing product.

The normally liquid fuel compositions of this invention are generally derived from petroleum sources, e.g., normally liquid petroleum distillate fuels, though they may include those produced synthetically by the Fischer-Tropsch and related processes, the processing of organic waste material or the processing of coal, lignite or shale rock. Such fuel compositions have varying boiling ranges, viscosities, cloud and pour points, etc., according to their end use as is well known to those of skill in the art. Among such fuels are those commonly known as diesel fuels, distillate fuels, heating oils, residual fuels, bunker fuels, etc., which are collectively referred to herein as fuel oils. The properties of such fuels are well known to skilled artisans as illustrated, for example, by ASTM Specifications D #396-73, available from the American Society for Testing Materials, 1916 Race Street, Philadelphia, Pa. 19103.

The fuel compositions of the invention may be prepared by merely dispersing components (A) and (B) in an appropriate fuel oil at the desired level of concentration. Generally, depending on the fuel oil used, such dissolution may require mixing and some heating. Mixing may be accomplished by any of the many commercial methods, ordinary tank stirrers being adequate. Heating is not absolutely necessary, but mild heating, e.g., at 25°-95° C., greatly accelerates dispersion. The ratio of component (A) to component (B) is generally in the range of about 10:1 to about 1:10, preferably about 10:1 to about 1:1, and most preferably about 2:1 to about 1:1. The level of addition of component (A) in such fuel oil compositions is generally in the range of about 25 to about 1500 parts per million, preferably about 25 to about 1000 parts per million. The level of addition of component (B) is such so as to be within the above-indicated ratio ranges of addition of components (A) to (B). When mixtures of components (A)(i) and (A)(ii) are used, the total amount of component (A) is within the above-indicated ratios and levels of addition. If such mixtures are employed, the ratio of (A)(i) to (A)(ii) is in the range of about 10:1 to about 1:10.

Alternatively, components (A) and (B) may be blended with suitable solvents to form concentrates that can be readily dissolved in the appropriate fuel compositions at the desired concentrations. Practical considerations involved in handling such as flash point must be considered in selecting the solvent. Since the concentrates may be subjected to cold temperatures, flow at these low temperatures is also a necessary consideration. Flow characteristics are dependent upon the particular components (A) and (B) and their concentration. Substantially inert normally liquid organic diluents such as mineral oil, naphtha, benzene, toluene, xylene or mixtures thereof are preferred for forming such additive concentrates. These concentrates usually contain about 10% to about 90% by weight, preferably about 10% to about 50% by weight of the composition of this invention and may contain, in addition, one or more other additives known in the art.

As indicated previously, the compositions of the present invention are particularly suitable for imparting pour point depressant and wax crystallization dispersion or suspension properties to fuel oils. Accordingly, the compositions of the invention extend the versatility of such fuel oils at lower service temperatures. The pour point depressant and wax suspension additives of the invention are particularly useful in heating oils and diesel fuels.

To illustrate the usefulness of the products of the invention as pour point depressants and wax suspension agents the products of Examples 36 and 38 were combined with a commercially available ethylene vinyl acetate copolymer solution (EVA) and mixed in a commercial fuel oil. The resulting fuel oil compositions were subjected to cold filter plugging point (CFPP) tests using "Cold Filter Plugging Point of Distillate Fuels" test No. IP 309/76 and to pour point depression tests using ASTM D 97-66. The EVA that was used was a commercially available ethylene vinyl acetate copolymer solution containing 42% by weight aromatic solvent and 58% copolymer. The copolymer had a vinyl acetate content of 36% by weight, a number average molecular weight of 2200 and approximately five methyl groups per 100 methylene groups. The base fuel that was used was No. 2 fuel oil supplied by Mobil Oil Company of France. Storage was for seven days at 0° C. (2° C. below the cloud point). Sample (1) contained no additive. Each of Samples (2), (3) and (4) contained 500 parts per million of the ethylene vinyl acetate copolymer solution, and the indicated levels of addition of the products of Examples 36 or 38. The results of these tests are indicated in Table I below.

In Table I the data under the column headings "Initial" are test data taken on samples before storage. The data under the column headings "Top 33% v" are test data taken after the seven day storage of the test samples taken from the top 33% by volume of the storage container. The data under the column headings "Btm 33% v" are test data taken after the seven day storage period of test samples taken from the bottom 33% by volume of the storage container.

TABLE I

| Sample | Additive | Level of Addition (PPM) | EVA (PPM) | CFPP Result*, (°C.) Initial | Top 33% v | Btm 33% v | Pour Point**, (°C.) Initial | Top 33% v | Btm 33% v |
|---|---|---|---|---|---|---|---|---|---|
| (1) | None | None | None | 0 | −1 | +3 | −6 | −6 | −6 |
| (2) | Product of Example 36 | 240 | 500 | −10 | −7 | −7 | −19 | −25 | −19 |
| (3) | Product of Example 38 | 320 | 500 | −7 | −6 | −6 | −17 | −16 | −19 |
| (4) | Product of Example 38 | 240 | 500 | −8 | −7 | −6 | −22 | −19 | −22 |

*Cold filter plugging point in °C. using IP 309/76.
**Pour point in °C. using ASTM D97-66.

The fuel compositions of this invention can contain, in addition to the products of this invention, other additives which are well known to those of skill in the art. These can include cetane improvers, anti-oxidants such as 2,6-di-tertiary-butyl-4-methylphenol, rust inhibitors, such as alkylated succinic acids and anhydrides, bacteriostatic agents, gum inhibitors, metal deactivators, and the like.

In one embodiment of the present invention, the afore-described compositions are combined with ashless dispersants for use in fuels. Such ashless dispersants are preferably esters of a mono- or polyol and a high molecular weight mono- or polycarboxylic acid acylating agent containing at least 30 carbon atoms in the acyl moiety. Such esters are well known to those of skill in the art. See, for example, French Pat. No. 1,396,645; British Pat. Nos. 981,850 and 1,055,337; and U.S. Pat. Nos. 3,255,108; 3,311,558; 3,331,776; 3,346,354; 3,579,450; 3,542,680; 3,381,022; 3,639,242; 3,697,428; 3,708,522; and British Patent Specification No. 1,306,529. These patents are expressly incorporated herein by reference for their disclosure of suitable esters and methods for their preparation.

In still another embodiment of this invention, the inventive additives are combined with Mannich condensation products formed from substituted phenols, aldehydes, polyamines, and substituted pyridines. Such condensation products are described in U.S. Pat. Nos. 3,649,659; 3,558,743; 3,539,633; 3,704,308; and 3,725,277, which are incorporated herein by reference for their disclosure of the preparation of the Mannich condensation products and their use in fuels.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

We claim:

1. A composition comprising:

a copolymer of ethylene and vinyl acetate, said copolymer having about 30 to about 40% by weight vinyl acetate, a number average molecular weight in the range of about 1500 to about 3000, and about 3 to about 6 methyl terminating side branches per 100 methylene groups; and the reaction product of a hydrocarbyl-substituted succinic anhydride with a mixture of aminopropylmorpholine and diethylenetriamine, the hydrocarbyl substituent of said succinic anhydride being a polymer of $C_{15-18}$ alpha-olefins, the number average molecular weight of said substituent being in the range of about 2000 to about 8000.

2. The composition of claim 1 wherein said ethylene/vinyl acetate copolymer has a number average molecular weight in the range of about 2000 to about 2500 and about 5 methyl terminating side branches per 100 methylene groups.

3. An additive concentrate comprising about 10% to about 90% by weight of the composition of any one of claims 1 or 2, and a substantially inert normally liquid organic diluent.

* * * * *